US012016432B1

(12) United States Patent
Steer

(10) Patent No.: US 12,016,432 B1
(45) Date of Patent: Jun. 25, 2024

(54) ARTICLE OF FOOTWEAR

(71) Applicant: David Steer, St. Albert (CA)

(72) Inventor: David Steer, St. Albert (CA)

( * ) Notice: Subject to any disclaimer, the term of this patent is extended or adjusted under 35 U.S.C. 154(b) by 0 days.

(21) Appl. No.: 18/466,069

(22) Filed: Sep. 13, 2023

(51) Int. Cl.
*A43B 11/00* (2006.01)
*A43B 3/24* (2006.01)
*A43B 3/26* (2006.01)

(52) U.S. Cl.
CPC ..... *A43B 3/26* (2013.01); *A43B 3/24* (2013.01); *A43B 11/00* (2013.01)

(58) Field of Classification Search
CPC .. A43B 11/00; A43B 3/26; A43B 3/24; A43B 3/246
See application file for complete search history.

(56) References Cited

U.S. PATENT DOCUMENTS 2,261,125 A * 11/1941 McFeely ..... A43B 3/24 36/12
2,815,588 A * 12/1957 Ruane ..... A43B 11/00 36/138
3,000,116 A * 9/1961 Ally ..... A43B 3/122 36/11.5
3,389,481 A * 6/1968 England ..... A43B 3/26 36/97
5,692,322 A * 12/1997 Lombardino ..... A43B 21/36 36/36 A
6,138,385 A * 10/2000 Jungkind ..... A43B 13/16 36/31
6,438,872 B1 * 8/2002 Chil ..... A43B 3/26 36/97
7,055,268 B2 6/2006 Ha
D560,882 S 2/2008 Tvoua et al.
D581,142 S 11/2008 Tvoua et al.
D584,884 S 1/2009 Tvoua et al.
D595,485 S 7/2009 Tvoua et al.
7,565,755 B2 7/2009 Tvoua et al.
D609,437 S 2/2010 Tvoua et al.
7,814,605 B1 * 10/2010 Tippel ..... A43B 1/009 36/97
8,011,119 B2 9/2011 Tvoua et al.
9,392,844 B1 * 7/2016 Burrell ..... A43B 3/0078
10,159,302 B2 12/2018 Carlson et al.
10,602,802 B2 3/2020 Hopkins et al.
10,702,005 B2 7/2020 Bigolin
10,779,607 B1 9/2020 Chandel
11,134,746 B2 10/2021 Seid
11,185,125 B2 11/2021 Blanche et al.
11,369,162 B2 6/2022 Chan et al.
2002/0069557 A1 * 6/2002 Miller ..... A43B 3/0078 36/97

(Continued)

*Primary Examiner* — Marie D Bays
(74) *Attorney, Agent, or Firm* — Burris Law, PLLC

(57) ABSTRACT

An article of footwear includes a sole structure, a heel assembly and an actuator assembly. The heel assembly includes a lower heel movable relative to the sole structure and an upper heel movable relative to the sole structure. One of the lower heel and upper heel defines a track and the other of the lower heel and the upper heel includes a protrusion slidably received in the track. The actuator assembly is coupled to the heel assembly and configured to move the upper heel relative to the lower heel between a closed position and an open position.

20 Claims, 28 Drawing Sheets

(56) References Cited

U.S. PATENT DOCUMENTS

| | | | | |
|---|---|---|---|---|
| 2003/0097770 | A1* | 5/2003 | Karasawa | A43B 3/06 36/97 |
| 2003/0106244 | A1* | 6/2003 | Miller | A43B 23/24 36/97 |
| 2004/0107604 | A1* | 6/2004 | Ha | A43B 1/0018 36/97 |
| 2005/0055848 | A1* | 3/2005 | Miller | A43B 1/0072 36/97 |
| 2005/0115113 | A1* | 6/2005 | Miller | A43B 3/26 36/97 |
| 2005/0115114 | A1* | 6/2005 | Miller | A43B 3/26 36/97 |
| 2006/0230638 | A1* | 10/2006 | Cavasin | A43B 3/26 36/117.3 |
| 2007/0251126 | A1* | 11/2007 | Tvoua | A43B 3/108 36/97 |
| 2009/0272007 | A1* | 11/2009 | Beers | A43C 11/00 36/50.1 |
| 2015/0366288 | A1* | 12/2015 | Miller | A43B 3/26 36/97 |
| 2020/0008516 | A1* | 1/2020 | Chan | A43C 11/12 |
| 2020/0205512 | A1 | 7/2020 | Blanche et al. | |
| 2020/0268103 | A1* | 8/2020 | Levy | A43B 13/36 |
| 2022/0287407 | A1* | 9/2022 | Cheney | A43C 11/008 |

* cited by examiner

ARTICLE OF FOOTWEAR

FIELD

The present disclosure relates to an article of footwear, and more specifically, to an article of footwear that is adjustable.

BACKGROUND

The statements in this section merely provide background information related to the present disclosure and may not constitute prior art.

Conventional articles of footwear include an upper portion and a sole structure cooperating to define a foot compartment. The upper portion provides covering for the foot that is securely received in the foot compartment and positions the foot with respect to the sole structure. In addition, the upper portion may have a configuration that protects the foot and provides ventilation. The sole structure is secured to a lower surface of the upper portion and is generally positioned between the foot and any contact surface. In addition to attenuating ground reaction forces and absorbing energy, the sole structure may provide traction and control potentially harmful foot motion, such as over pronation, for example. Conventional articles of footwear are typically designed with the intention that they will provide improved comfort once the foot is properly positioned inside. However, the wearers comfort may change as time passes due to a change in the usage, such as standing rather than sitting, or as a result of a physiological change such as swelling in the foot.

These issues with conventional articles of footwear, among other issues, are addressed by the present disclosure.

SUMMARY

This section provides a general summary of the disclosure and is not a comprehensive disclosure of its full scope or all of its features.

In one form, the present disclosure discloses an article of footwear that includes a sole structure, a heel assembly and a first actuator. The sole structure defines a forwardmost toe location of the article of footwear. The heel assembly defines a rearmost heel location of the article of footwear. The heel assembly comprises a lower heel movable relative to the sole structure and an upper heel movable relative to the sole structure. One of the lower heel and upper heel defines a track and the other of the lower heel and the upper heel includes a protrusion slidably received in the track. The first actuator assembly is coupled to the heel assembly and configured to move the upper heel relative to the lower heel between a closed position and an open position.

In variations of the article of footwear of the above paragraph, which can be implemented individually or in any combination: an upper portion is removably secured to the sole structure to define a foot-receiving chamber; the upper portion is made of a stretchable material; the first actuator assembly includes a telescoping structure and an actuator, the telescoping structure is coupled with the upper heel and moveable between a closed state in which the upper heel is in the closed position and an open state in which the upper heel is in the open position and the actuator is configured to move the telescoping structure between the closed state and the open state; the first actuator assembly is disposed within a recess formed in the lower heel; the upper heel includes an arcuate body and a lip extending downward from the arcuate body, the lower heel includes an arcuate periphery that defines an opening that is configured to receive the lip of the upper heel, the telescoping structure is coupled to the lip of the upper heel; a sensor is configured to detect an object on the sole structure and a controller is in communication with the actuator and configured to actuate the actuator to move the telescoping structure from the open state to the closed state in response to the sensor detecting the object on the sole structure; a second actuator assembly configured to move the lower heel relative to the sole structure between an extended state and a retracted state; when the lower heel is in the retracted state, the forwardmost toe location and the rearmost heel location are spaced apart from each other a first distance, and when the lower heel is in the extended state, the forwardmost toe location and the rearmost heel location are spaced apart from each other a second distance that is greater than the first distance; the second actuator assembly is located outside the lower heel; the first actuator assembly is located at least partially inside the lower heel; and the lower heel is spaced apart from the sole structure.

In another form, the present disclosure discloses an article of footwear that includes a sole structure, a heel assembly, a first actuator, a sensor, and a controller. The sole structure defines a forwardmost toe location of the article of footwear. The heel assembly defines a rearmost heel location of the article of footwear. The heel assembly includes a lower heel and an upper heel. The lower heel is movable relative to the sole structure between a retracted state in which the forwardmost toe location and the rearmost heel location are spaced apart from each other a first distance and an extended state in which the forwardmost toe location and the rearmost heel location are spaced apart from each other a second distance. The second distance being greater than the first distance. The upper heel is movable relative to the lower heel between a closed position and an open position. The first actuator assembly is coupled to the heel assembly and configured to move the upper heel relative to the lower heel between the closed position and the open position. The sensor is configured to detect an object on the sole structure. The controller is in communication with the sensor and the first actuator assembly. The controller is configured to: determine whether the object is on the sole structure and actuate the first actuator assembly to move the upper heel from the open position to the closed position in response to the sensor detecting the object on the sole structure.

In variations of the article of footwear of the above paragraph, which can be implemented individually or in any combination: an upper portion is removably secured to the sole structure to define a foot-receiving chamber; the upper heel includes an arcuate body and a lip extending downward from the arcuate body, the lower heel includes an arcuate periphery that defines an opening that is configured to receive the lip of the upper heel, the first actuator assembly includes a telescoping structure that is coupled to the lip of the upper heel; a second actuator assembly configured to move the lower heel relative to the sole structure between the extended state and the retracted state; the second actuator assembly is located outside the lower heel; the first actuator assembly is located at least partially inside the lower heel; a cover member is coupled to the heel assembly and the sole structure, the cover member covers a gap between the heel assembly and the sole structure.

In another form, the present disclosure discloses an article of footwear that includes a sole structure, a heel assembly, a cover member, first and second actuator assemblies, a sensor, and a controller. The sole structure defines a forwardmost toe location of the article of footwear. The heel assembly defines a rearmost heel location of the article of footwear. The heel assembly includes a lower heel and an upper heel. The lower heel is movable relative to the sole structure between a retracted state in which the forwardmost toe location and the rearmost heel location are spaced apart from each other a first distance and an extended state in which the forwardmost toe location and the rearmost heel location are spaced apart from each other a second distance. The second distance being greater than the first distance. The upper heel is movable relative to the lower heel between a closed position and an open position. The cover member is coupled to the heel assembly and the sole structure. The cover member covers a gap between the heel assembly and the sole structure. The first actuator assembly is coupled to the heel assembly and configured to move the upper heel relative to the lower heel between the closed position and the open position. The first actuator assembly is located at least partially inside the lower heel. The second actuator assembly is coupled to the sole structure and the lower heel. The second actuator assembly is configured to move the lower heel relative to the sole structure between the extended state and the retracted state. The second actuator assembly is located outside of the lower heel. The sensor is configured to detect an object on the sole structure. The controller is in communication with the sensor and the first and second actuator assemblies. The controller is configured to: actuate the second actuator assembly to move the lower heel to a preset position relative to the sole structure; determine whether the object is on the sole structure; and actuate the first actuator assembly to move the upper heel from the open position to the closed position in response to the sensor detecting the object on the sole structure.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
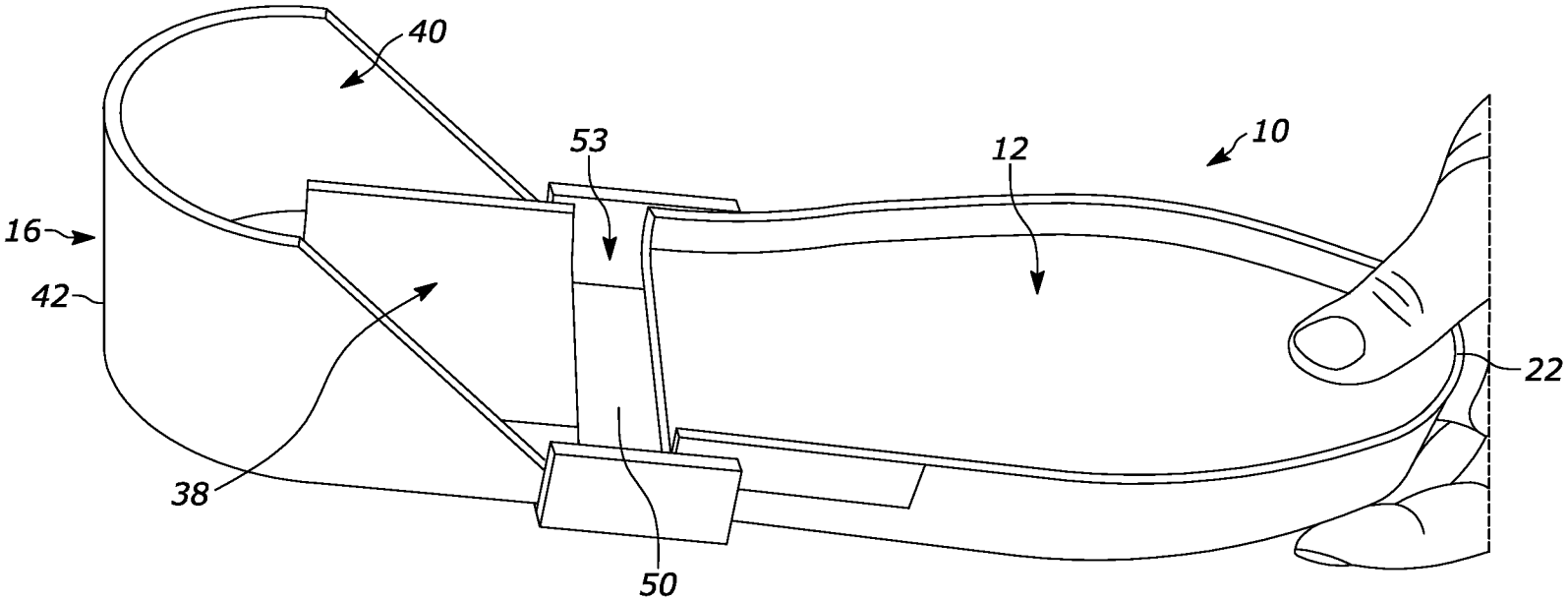
FIG. 1 is a perspective view of a portion of an article of footwear including a heel assembly with a lower heel in a closed position and an upper heel in a first position according to the principles of the present disclosure.
Figure 2:
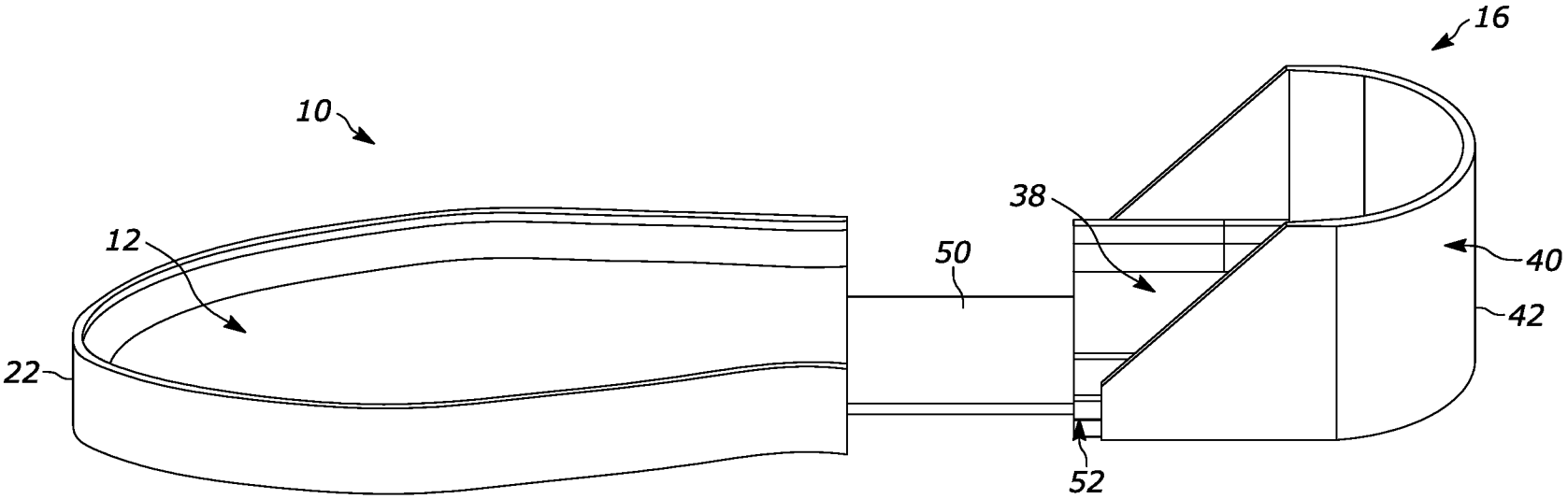
FIG. 2 is a perspective view of the portion of the article of footwear of FIG. 1 with the lower heel in an open position and a cover of the article of footwear removed for clarity.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure relates to an article of footwear including a sole structure and a heel assembly. The sole structure defines a forwardmost toe location of the article of footwear and the heel assembly defines a rearmost heel location of the article of footwear. The heel assembly includes a lower heel and an upper heel. One of the lower heel and the upper heel defines a track and the other of the lower heel and the upper heel includes a protrusion slidably received in the track. The lower heel is movable relative to the sole structure between a closed state in which the forwardmost toe location and the rearmost heel location are spaced apart from each other a first distance and an open state in which the forwardmost toe location and the rearmost heel location are spaced apart from each other a second distance. The second distance is greater than the first distance. The upper heel is movable relative to the lower heel among a plurality of positions when the lower heel is in the closed state.

Referring to the figures in the present disclosure, an article of footwear is illustrated that is allowed to accommodate a range of shoe sizes. In one form, the article of footwear 10 is allowed to accommodate shoe sizes ranging from 10 centimeters (cm) to 20 centimeters (cm). In another form, the article of footwear 10 is allowed to accommodate shoe sizes ranging from 22 centimeters to 33 centimeters. The article of footwear includes, but is not limited to: athletic shoes such as a walking shoes, skates, or ski boots, for example. In other forms, the article of footwear can be non-athletic shoes such as sandals, safety/work boots, medical shoes, pet shoes (e.g., dog booties), raised platform shoes, as well as other foot-receiving apparatuses.

With reference to FIGS. 1-3, 4A, and 4B, in one form, the article of footwear 10 includes a sole structure 12, an upper portion (not shown), and a heel assembly 16. The sole structure 12 extends in a longitudinal direction of the article of footwear 10 and defines a forwardmost toe location 22. As used herein, the term "forwardmost toe location" means the forwardmost location of the article of footwear 10 that extends in the longitudinal direction. The sole structure can be formed by a midsole and/or an outsole. In some forms, the article of footwear 10 includes orthotics/podiatrist insoles (not shown) disposed on the sole structure (e.g., disposed on the midsole of the sole structure) and providing additional cushioning, for example, to the article of footwear 10. The midsole can be one or more impact force attenuating components such as one or more fluid-filled bladders, one or more polymeric foam components, or one or more mechanical shock absorber structures, for example.

Figure 5:
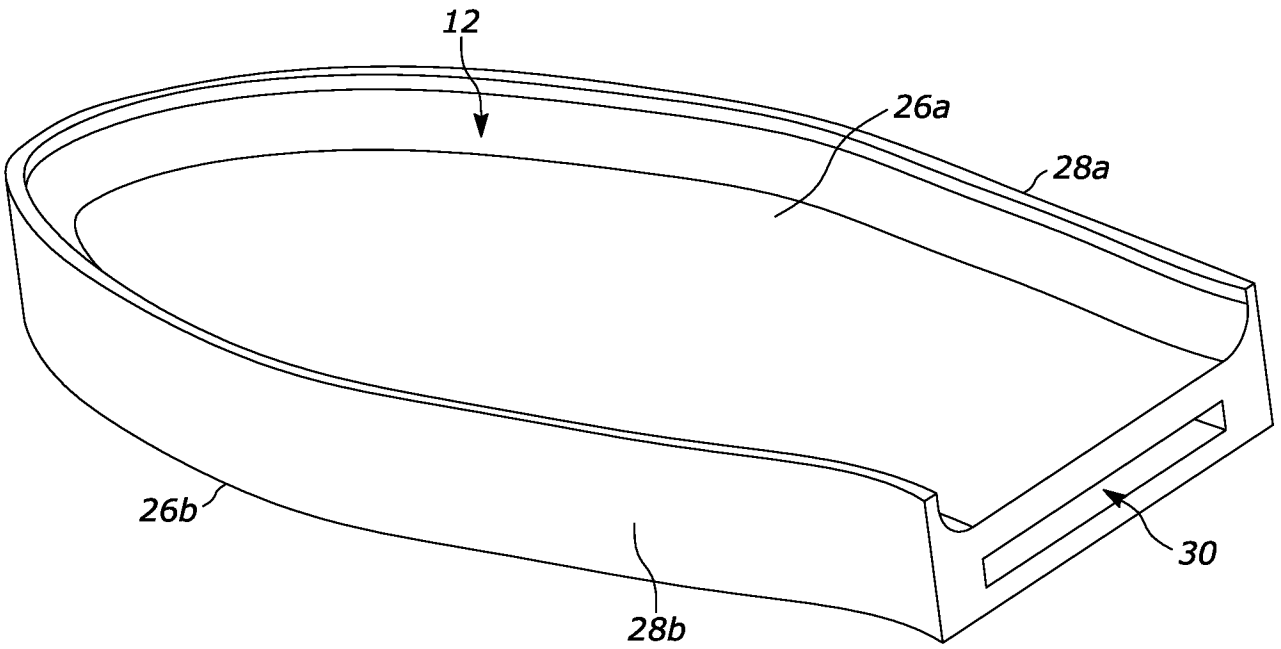
FIG. 5 is a perspective view of a sole structure of the article of footwear of FIG. 1.

The outsole can be made of a rubber material, for example, and can include rigid attachment points for ground-contacting components and/or traction enhancing components, such as treads, cleats, spikes (e.g., golf spikes, ice spikes), and wheels, for example. In some forms, the outsole can include one or more rigid mounting points for devices such as a camera to be mounted thereto. With additional reference to FIG. 5, in the example illustrated, the outsole of the sole structure 12 includes an upper surface 26*a* and a lower surface 26*b* configured to contact a ground surface. A pocket 30 is formed in the outsole between the upper and lower surfaces 26*a*, 26*b*. The pocket 30 is also formed in the outsole between a lateral side 28*a* of the sole structure 12 and a medial side 28*b* of the sole structure 12. As used herein, the term "lateral side" means the outside of the article of footwear 10 and the term "medial side" means the inside of the article of footwear 10. In some forms, the pocket 30 may be formed in the midsole of the sole structure 12 instead of the outsole of the sole structure 12.

In the example illustrated, the sole structure 12 is stationary (i.e., not movable relative to other components of the article of footwear 10). In some forms, as will be described in more detail below, the sole structure 12 is movable in one or more directions relative to other components of the article of footwear 10.

In the example illustrated, the upper portion (not shown) is removably secured to the sole structure 12 to define a foot-receiving chamber configured to receive an object (i.e., a foot of a user). That is, the upper portion is removably secured to the sole structure 12 by VELCRO®, hook-and-loop fasteners, zippers, or any other suitable attachment means. In this way, cleaning of the upper portion is facilitated. In some forms, the upper portion can be permanently secured to the sole structure 12 using glue, adhesives, or any other suitable attachments means. Still in other forms, the upper portion can be semi-permanently attached to the sole structure 12 using laces, stitching, or any other suitable attachment means. The upper portion is made of a stretchable material or fabric that is allowed to stretch between 1%-100% of its original state. In this way, the upper portion is allowed to adjust for different sized feet (e.g., feet having different dimensions (e.g., lengths and/or widths) or whose dimensions change during use) received in the foot-receiving chamber. Stated differently, the article of footwear 10 can be adjusted for different sized feet by pulling or releasing a part of the upper portion that is secured to an underside or side of the toe/foot portion. In some forms, the upper portion may be made of one or more parts sewn or otherwise secured to each other. In some forms, the upper portion includes an attachment structure to facilitate securement of the article of footwear 10 to a foot of a wearer. The attachment structure may include a conventional lace system or one or more straps or belts such as releasably fixed in place by buckles, buttons, hook-and-loop fasteners, for example.

With reference to FIGS. 1-3 and 6-8, the heel assembly 16 includes a lower heel 38 and an upper heel 40. The heel assembly 16 also defines a rearmost heel location 42. As used herein, the term "rearmost heel location" means the rearmost location of the article of footwear 10 that extends in the longitudinal direction. In the example illustrated, the upper heel 40 of the heel assembly 16 defines the rearmost heel location 42. In some forms, the lower heel 38 defines the rearmost heel location 42. Still in other forms, both the lower heel 38 and the upper heel 40 define the rearmost heel location.

Figure 4A:
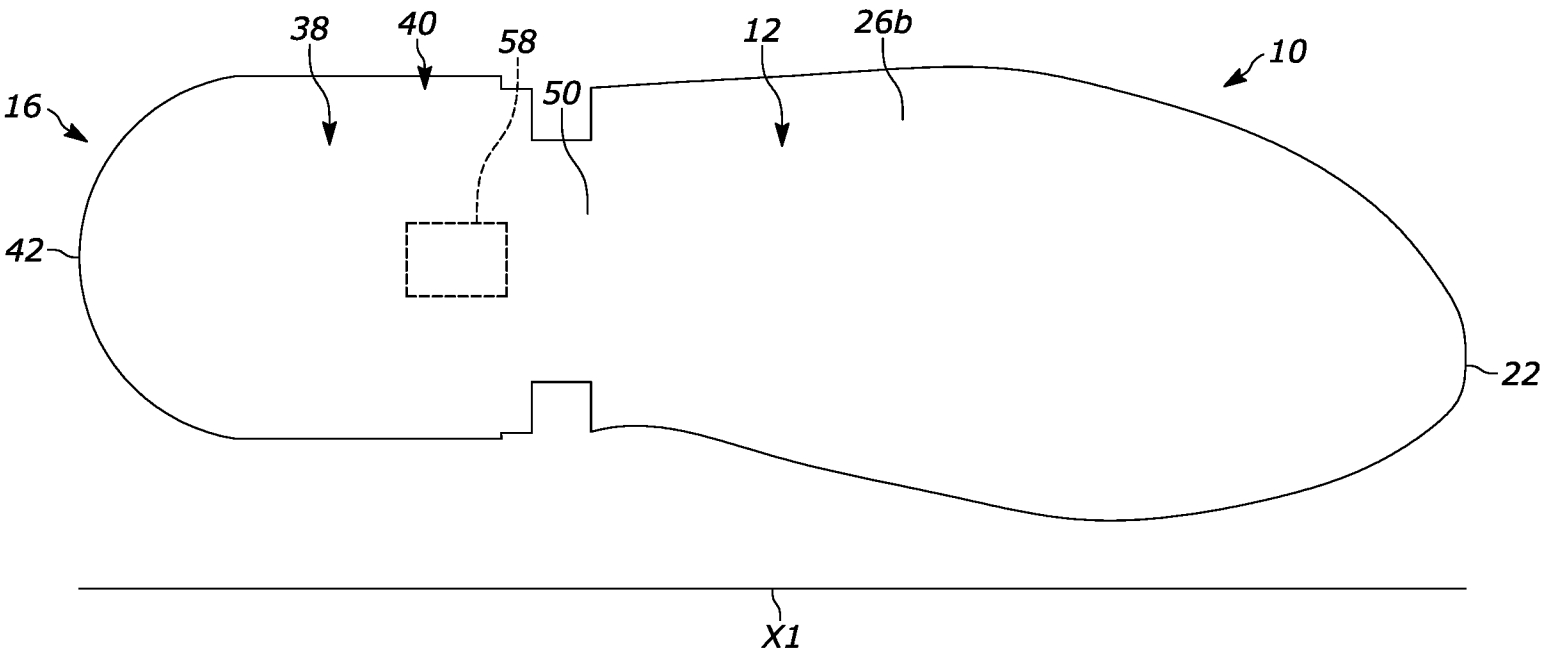
FIG. 4A is a bottom view of the portion of the article of footwear of FIG. 1 in the closed position with the cover removed for clarity.
Figure 4B:
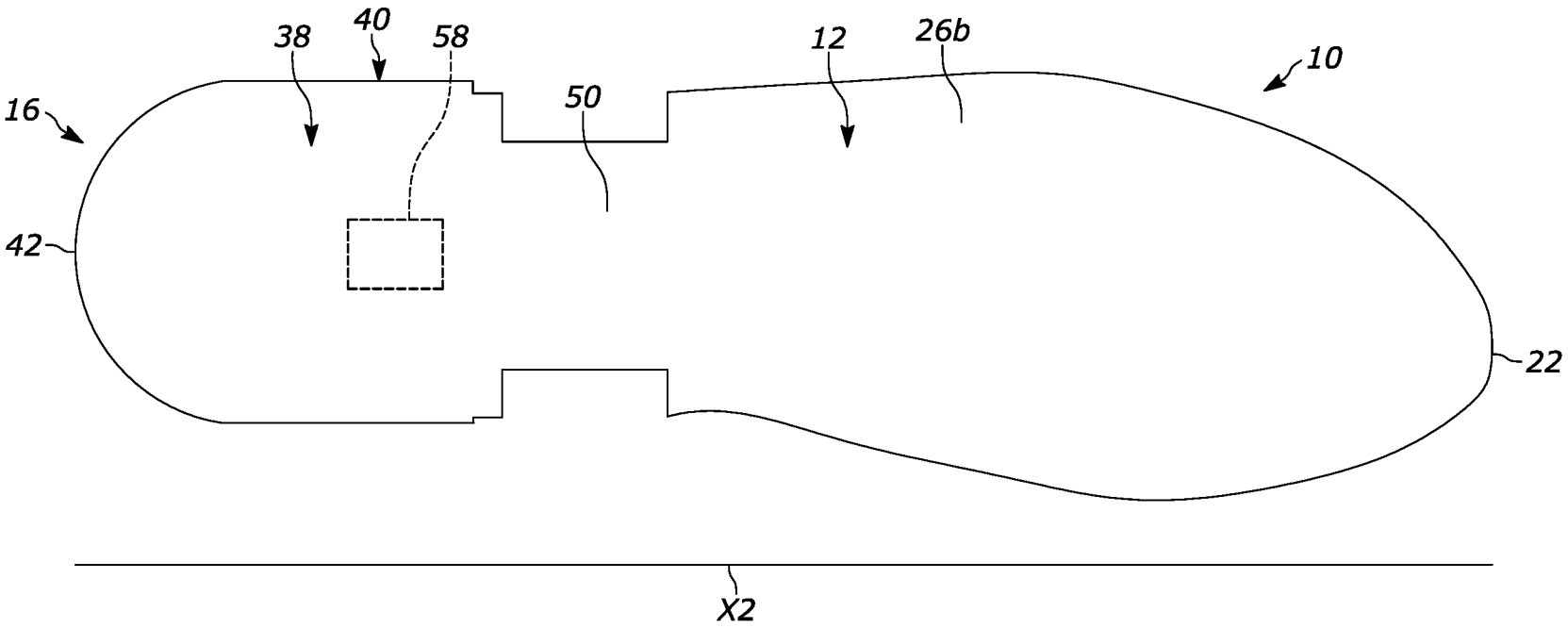
FIG. 4B is a bottom view of the portion of the article of footwear of FIG. 1 in the open position with the cover removed for clarity.

The lower heel 38 is configured to support a heel of a foot received in the foot-receiving chamber and is movable relative to the sole structure 12 (and the upper portion). That is, the lower heel 38 is movable in the longitudinal direction of the article of footwear 10 between a closed state in which the forwardmost toe location 22 and the rearmost heel location 42 are spaced apart from each other a first distance X1 (FIG. 4A), and an open state in which the forwardmost toe location 22 and the rearmost heel location 42 are spaced apart from each other a second distance X2 (FIG. 4B). As shown in FIG. 4B, the second distance X2 is greater than the first distance X1.

In some forms, the heel assembly 16 (i.e., lower heel 38 and upper heel 40) is stationary and the sole structure 12 is movable in the longitudinal direction between a closed state in which the forwardmost toe location 22 and the rearmost heel location 42 are spaced apart from each other the first distance, and an open state in which the forwardmost toe location 22 and the rearmost heel location 42 are spaced apart from each other the second distance X2 that is greater than the first distance X1. Alternatively or additionally, the sole structure 12 may be split or separated into a left part and a right part that are movable in a transverse direction (i.e., perpendicular to the longitudinal direction of the article of footwear 10) relative to each other, thereby allowing a width of the article of footwear 10 to be adjusted.

Figure 6:
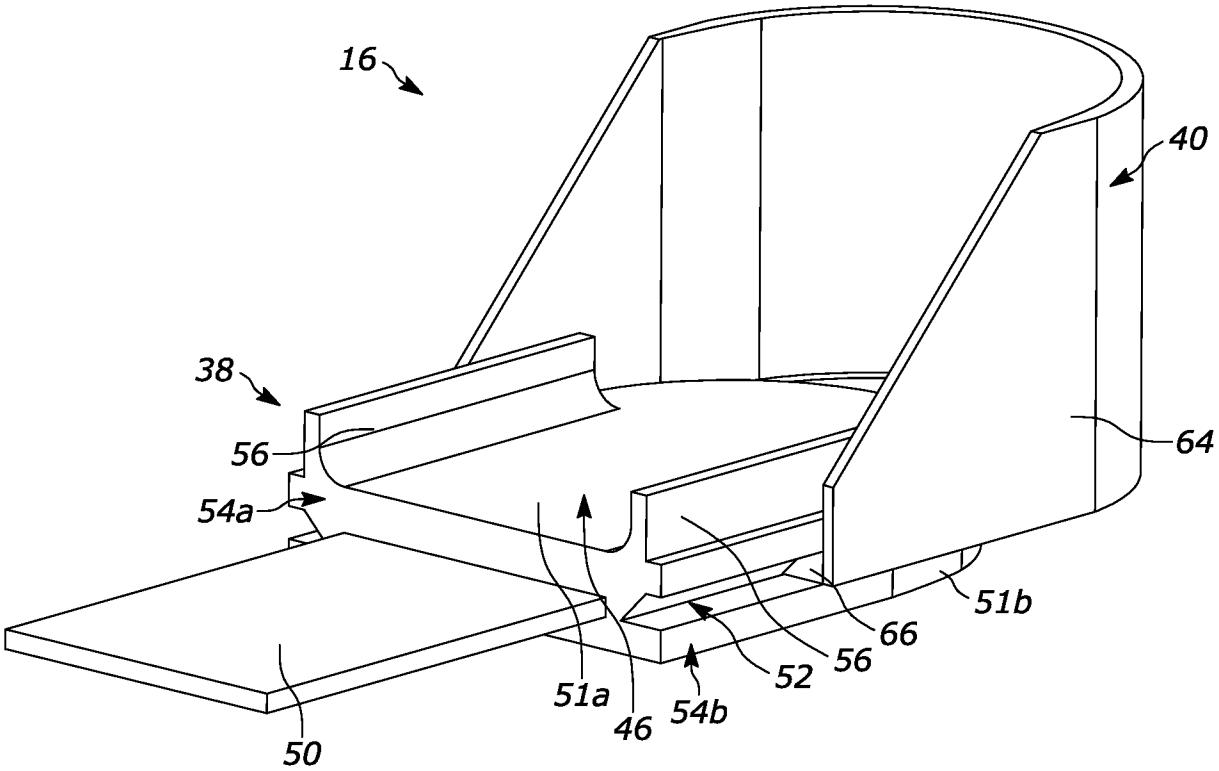
FIG. 6 is a perspective view of the heel assembly of the article of footwear of FIG. 1.
Figure 8:
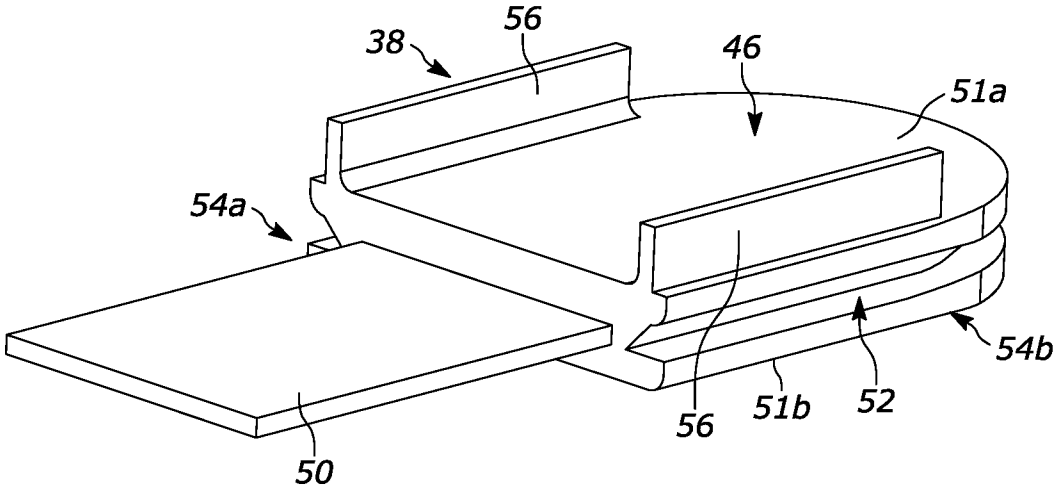
FIG. 8 is a perspective view of the lower heel of the heel assembly of the article of footwear of FIG. 1.

With reference to FIGS. 6 and 8, the lower heel 38 includes a body 46, an upper tab (not shown), and a lower tab 50. In the example illustrated, the body 46 is spaced apart from the sole structure 12 when the lower heel 38 is in the closed state. In some forms, the body 46 engages or contacts the sole structure 12 when the lower heel 38 is in the closed state. In one example, if the article of footwear 10 accommodates shoe sizes ranging from 10 centimeters to 20 centimeters, the body 46 may engage the sole structure 12 when the lower heel 38 is in the closed state. In another example, if the article of footwear 10 accommodates shoe sizes ranging from 20 centimeters to 30 centimeters, the body 46 may be spaced apart from the sole structure 12 when the lower heel 38 is in the closed state. An optional cover member 53 (FIG. 1) may at least partially wrap around the sole structure 12 and the lower heel 38 to cover a gap therebetween when the lower heel 38 is in the closed state. In the example illustrated, the cover member 53 has a U-shape and is secured to one or both of the sole structure 12 and the lower heel 38 using adhesives, mechanical fasteners, a snap-fit, or any other suitable attachment means.

The body 46 has an upper surface 51*a*, a lower surface 51*b*, and a track 52 defined between the upper and lower surfaces 51*a*, 51*b*. The track 52 is formed in and around a periphery thereof. That is, in the example illustrated, the track 52 is formed in the body 46 and extends from a lateral side 54*a* of the lower heel 38 around to a medial side 54*b* of the lower heel 38. The lower heel 38 may optionally include a pair of flanges 56 that extend vertically upward from the upper surface 51*a*. That is, one flange 56 of the pair of flanges 56 extends upward from the upper surface 51*a* proximate the medial side 54*b* of the lower heel 38 and the other flange 56 of the pair of flanges 56 extends upward from the upper surface 51*a* proximate the lateral side 54*a* of the lower heel 38. In one form, the flanges 56 may provide additional support to the upper portion, thereby retaining the upper portion in the desired position.

The upper tab (not shown) extends in a forward direction (i.e., toward the forwardmost toe location 22) from a front end of the body 46 onto the upper surface 26*a* of the sole structure 12. In this way, the upper tab is support by and slidably engaged with the upper surface 26*a* of the sole structure 12 as the lower heel 38 moves between the closed state and the open state. In some forms, the upper surface 26*a* of the sole structure 12 may optionally includes a recess formed therein that the upper tab is slidably received in. In some forms, the upper tab that is received in the recess has a ramped or inclined profile such that the upper tab and the upper surface 26*a* of the sole structure 12 are substantially flush as the lower heel 38 moves between the closed state and the open state.

The lower tab 50 extends in a forward direction (i.e., toward the forwardmost toe location 22) from the front end of the body 46 into the pocket 30 of the sole structure 12. In this way, the lower tab 50 is partially supported by the sole structure 12 and is slidably engaged within the pocket 30 as the lower heel 38 moves between the closed state and the open state. In some forms, the lower tab 50 extends further in the forward direction than the upper tab. In some forms, the upper tab extends further in the forward direction than the lower tab 50.

Figure 9:
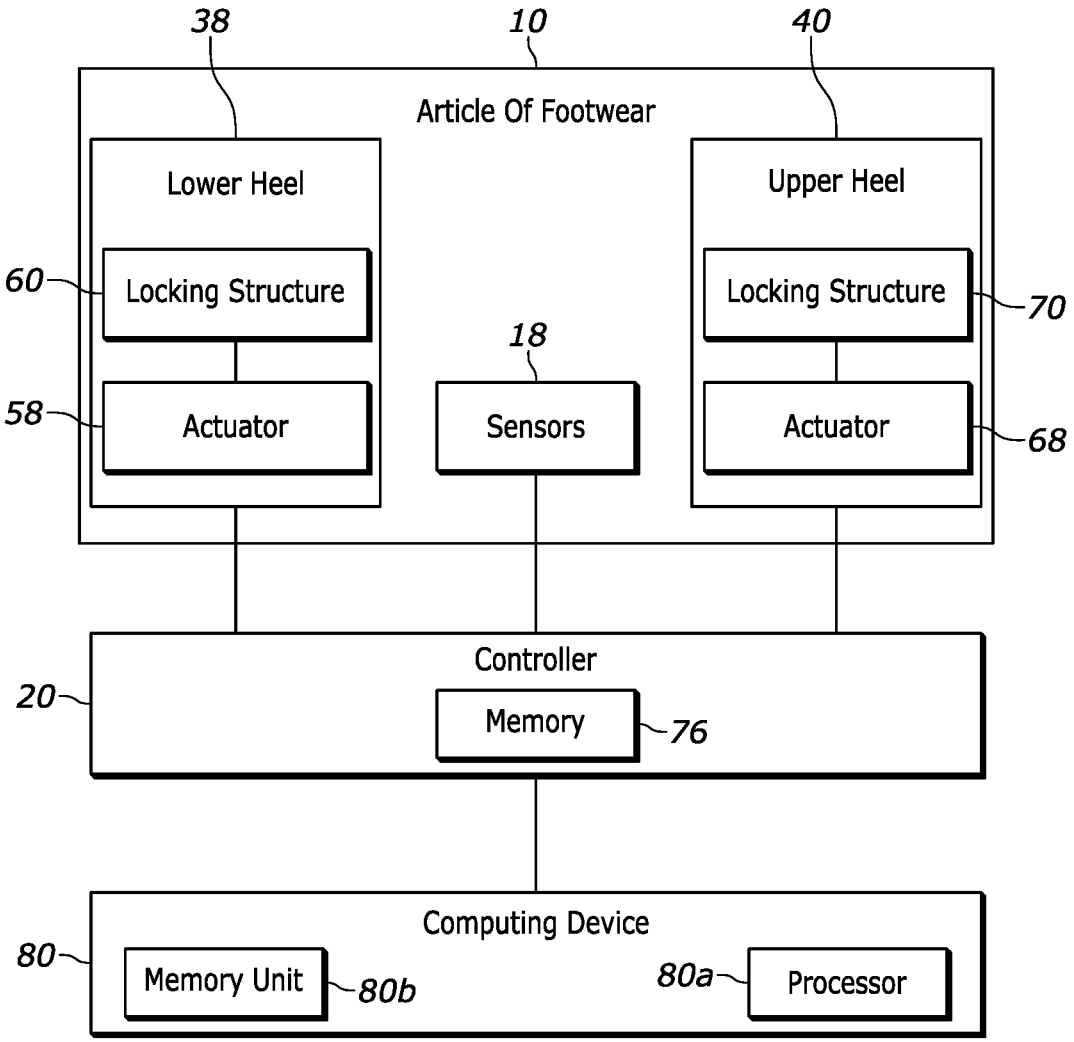
FIG. 9 is a block diagram illustrating communication between components of the article of footwear and a controller.

With reference to FIG. 9, one or more actuator assemblies 58 (FIGS. 4A and 4B) are associated with the lower heel 38 and are configured to move the lower heel 38 in the longitudinal direction of the article of footwear 10 between the closed state and the open state. In one example, each actuator assembly 58 may be a jackscrew assembly that includes a worm screw, a worm gear, a lead screw and a motor. The worm screw is rotated by the motor, which, in turn, rotates the worm gear. Rotation of the worm gear causes linear motion of the lead screw, which is connected to the lower heel 38 via a nut, for example. Linear motion of the lead screw causes the lower heel 38 secured thereto to move in the longitudinal direction of the article of footwear 10. In this way, operation of the motor in a first operation mode causes the lower heel 38 to move relative to the sole structure 12 in a first longitudinal direction (e.g., the first longitudinal direction may be away from the sole structure 12) and operation of the motor in a second operation mode causes the lower heel 38 to move relative to the sole structure 12 in a second longitudinal direction (the second longitudinal direction may be toward the sole structure 12). The motor may be an electric motor or any other suitable motor that rotates the worm screw. In another example, each actuator assembly 58 may include electrical components (e.g., batteries, coils, motors) that operate to move the lower heel 38 between the closed state and the open state. The electrical components may be secured to the lower heel 38 (e.g., located within a fluid tight pocket formed in the lower heel).

A locking structure 60 is configured to engage a respective actuator assembly 58 and is movable between a locked position in which the lower heel 38 is inhibited from moving between the closed and open states, and an unlocked position in which the lower heel 38 is allowed to move between the closed and open states. In one form, the locking structure 60 may be a set screw, for example. In some forms, the locking structure 60 extends through the heel assembly 16 and is accessible from outside the article of footwear 10. In this way, the locking structure 60 may be manually movable between the locked and unlocked positions by a wearer of the article of footwear 10. Still in other forms, the locking structure 60 may include electrical components (e.g., batteries, coils, motors) that are configured to inhibit movement of the lower heel 38 and allow movement of the lower heel 38.

Figure 7:
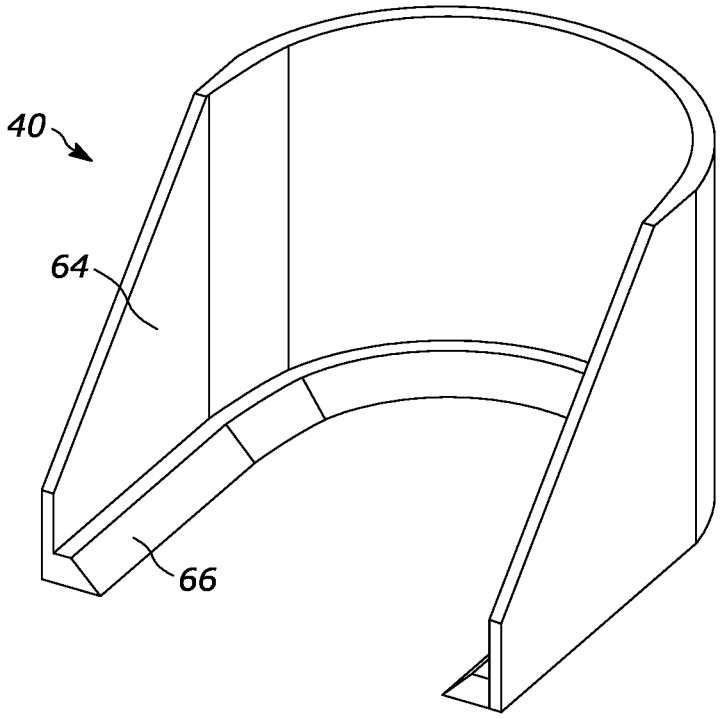
FIG. 7 is a perspective view of the upper heel of the heel assembly of the article of footwear of FIG. 1.

With reference to FIGS. 6 and 7, the upper heel 40 is configured to support the heel of a foot received in the foot-receiving chamber and is movable in the longitudinal direction relative to the lower heel 38 (and the sole structure 12) among a plurality of positions when the lower heel 38 is in the closed or open states. The upper heel 40 is slidably engaged with the lower heel 38 and extends vertically upward beyond the lower heel 38. In the example illustrated, the upper heel 40 is shown as a single component and includes an arcuate body 64 and a protrusion 66. In some forms, the upper heel 40 includes a multi-part structure having an outer part and an inner part. The outer part may be made of a rigid material such as a plastic material, non-foam material, thermoplastic material, thermosetting material, fiber reinforced plastic material, and/or metal or metal alloy materials. The inner part may directly engage the heel of the wearer and may be made from a softer material relative to the outer part such as polymeric foam, fabric, and/or textile, for example.

In the example illustrated, the protrusion 66 extends inwardly and around a lower part of an inner surface of the body 64 into the track 52 of the lower heel 38. In this way, the upper heel 40 is slidably engaged with the lower heel 38. It should be understood that, in some forms, the protrusion may be associated with the lower heel 38 and the track 52 may be formed in the upper heel 40. When the protrusion 66 is received in the track 52 of the lower heel 38, the upper heel 40 is substantially inhibited from moving in a vertical direction and a lateral direction relative to the lower heel 38. In some forms, a stop assembly (not shown) is associated with the upper and lower heels 38, 40 to inhibit the protrusion 66 of the upper heel 40 from being removed from the track 52 of the lower heel 38. In one example, the stop assembly may include one or more first members (e.g., projections or bosses) extending lateral inward from sides of the body 64 of the upper heel 40 near or at a front end thereof, and one or more second members (e.g., projections or bosses) extending laterally outward from sides of the lower heel 38 near or at a rear end thereof. The first and second members may cooperate to engage each other prior to the protrusion 66 of the upper heel 40 being removed from the track 52 of the lower heel 38.

Figure 3:
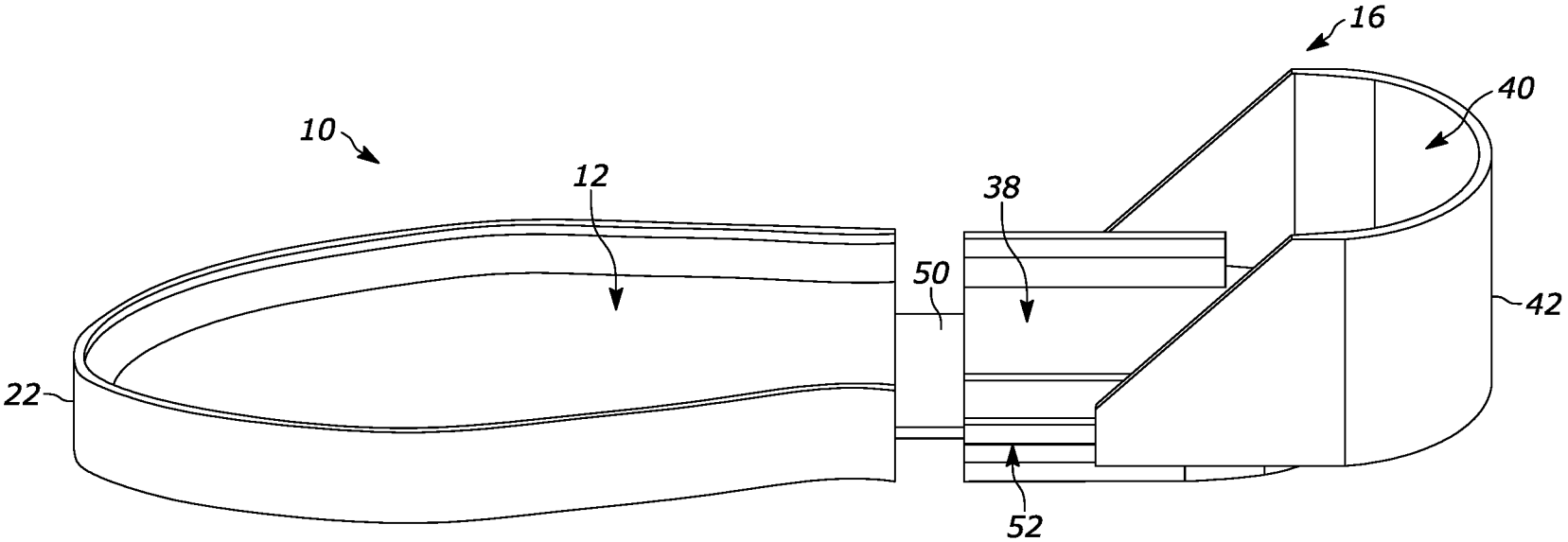
FIG. 3 is a perspective view of the portion of the article of footwear of FIG. 1 with the lower heel in the closed position, the upper heel in a second position and the cover member removed for clarity.

With reference to FIG. 9, one or more actuator assemblies 68 are associated with the upper heel 40 and are configured to move the upper heel 40 in the longitudinal direction of the article of footwear 10 among the plurality of positions (compare FIGS. 1 and 3 showing the upper heel 40 in different positions). In one example, each actuator assembly 68 may be a jackscrew assembly as described above with respect to actuator assembly 58. In this way, operation of a motor of the actuator assembly 68 in a first operation mode causes the upper heel 40 to move relative to the lower heel 38 (and the sole structure 12) in the first longitudinal direction and operation of the motor in a second operation mode causes the upper heel 40 to move relative to the lower heel 38 (and the sole structure 12) in the second longitudinal direction. In another example, each actuator assembly 58 may include electrical components (e.g., batteries, coils, motors) that operate to move the upper heel 40 between the closed state and the open state. The electrical components may be secured to the upper heel 40.

A locking structure 70 is configured to engage a respective actuator assembly 68 and is movable between a locked position in which the upper heel 40 is inhibited from moving in the longitudinal direction, and an unlocked position in which the upper heel 40 is allowed to move in the longitudinal direction. In one form, the locking structure 70 may be a set screw, for example. In some forms, the locking structure 70 extends through the heel assembly 16 and is accessible from outside the article of footwear 10. In this way, the locking structure 70 may be manually movable between the locked and unlocked positions by a wearer of the article of footwear 10. Still in other forms, the locking structure 70 may include electrical components (e.g., batteries, coils, motors) that are configured to inhibit movement of the upper heel 40 and allow movement of the lower heel 38. In some forms, the article of footwear 10 includes one locking structure (not shown) instead of two locking structures 60, 70. The one locking structure includes electrical components (e.g., batteries, coils, motors) and is configured to selectively allow movement of both the upper heel 40 and the lower heel 38.

The electrical components of the article of footwear 10 can be charged using wireless charging methods (e.g., induction charging and/or solar charging), wired charging methods (e,g., plugging in the article of footwear 10 to a power source), or other charging methods such as using kinetic energy (e.g., kinetic energy generated from walking) to charge the article of footwear 10. It should be understood that the moving parts of the article of footwear 10 can be achieved using mechanical means, electrical means, or a combination of both mechanical and electrical means.

Sensors 18 are associated with the article of footwear 10 and are configured to detect a foot in the foot-receiving chamber. That is, the sensors 18 may be secured to one or more of the sole structure 12, the upper portion, and the heel assembly 16 of the article of footwear 10 and configured to detect a foot in the foot-receiving chamber. In one example, the sensors 18 may be embedded in one or more of the sole structure 12, the upper portion, and the heel assembly 16. In one example, the sensors 18 are pressure sensors that measure a pressure of a foot on the sole structure 12. In another example, the sensors 18 are proximity sensors that sense the presence of a foot in the foot-receiving chamber. In yet another example, the sensors 18 are position sensors configured to determine a position of a foot in the foot-receiving chamber. The sensors 18 may also be a combination of pressure sensors, proximity sensors and/or position sensors.

A controller 20 is in communication with the sensors 18, the lower heel 38 (e.g., the actuator assemblies 58 and/or locking structure 60), and the upper heel 40 (e.g., the actuator assemblies 68 and/or locking structure 70), and may monitor and control operations of the lower heel 38 and the upper heel 40 based on data received from the sensors 18. In one example, the controller 20 is in communication with the sensors 18, the lower heel 38, and the upper heel 40 using a wireless communication protocol (e.g., a Bluetooth®-type protocol, a cellular protocol, a wireless fidelity (Wi-Fi)-type protocol, a near-field communication (NFC) protocol, an ultra-wideband (UWB) protocol, among others). The controller 20 may be located within one of the sole structure 12 or the heel assembly 16. In some forms, the controller 20 may be located within a fluid-tight pocket within one of the sole structure 12 or the heel assembly 16.

Figure 10:
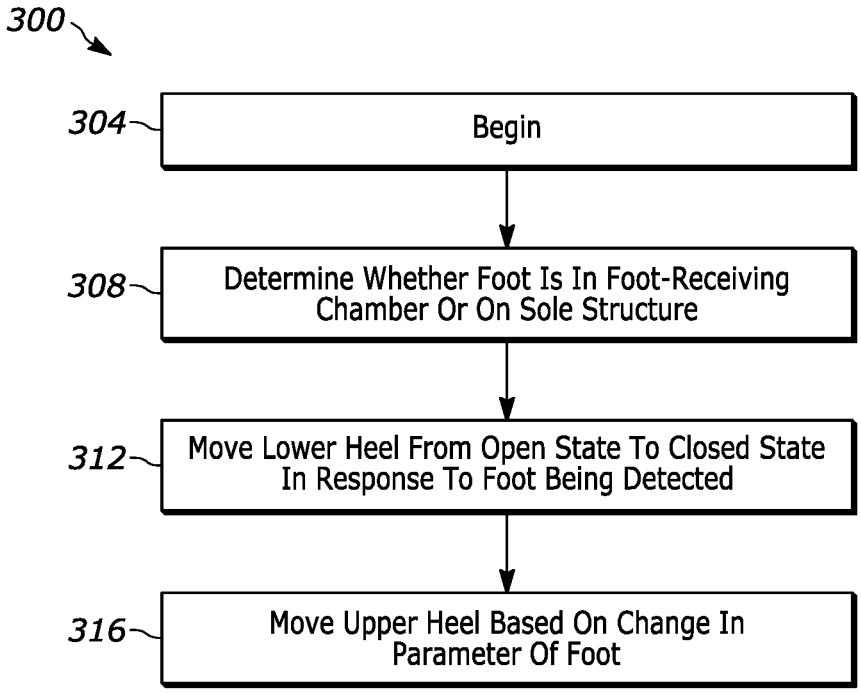
FIG. 10 is a flowchart depicting an algorithm for operating the heel assembly of the article of footwear of FIG. 1 in accordance with the teachings of the present disclosure.

Referring to FIG. 10, an example control algorithm 300 for controlling operations of the upper heel 40 and/or the lower heel 38 while the foot is received in the foot-receiving chamber is illustrated. The control algorithm begins at 304. At 308, the control algorithm, using the controller 20, determines whether a foot is in the foot-receiving chamber and/or on the sole structure 12 based on data received from the sensors 18.

At 312, the control algorithm, using the controller 20, moves the lower heel 38 from the open state to the closed state in response to the foot being detected within the foot-receiving chamber and/or on the sole structure 12. The closed state may correspond with a predetermined foot size of the wearer of the article of footwear 10 that is stored within a memory unit 76, which may be a nontransitory computer-readable medium, such as a random-access memory (RAM) and/or read-only memory (ROM). The memory unit 76 may store foot sizes and other data about wearers of the article of footwear 10.

At 316, the control algorithm, using the controller 20, moves the upper heel 40, after the lower heel 38 is moved to the closed state, from a first position of the plurality of positions to a second position of the plurality of positions based on a change in parameters of the foot within the foot-receiving chamber. In this way, a desired comfort level of the foot within the foot-receiving chamber is maintained during various activities while wearing the article of footwear 10. In one example, the controller 20 may move the upper heel 40 toward the forwardmost toe location 22 or away from the forwardmost toe location 22 in response to the positioning of the foot within the foot-receiving chamber changing. In another example, the controller 20 may move the upper heel 40 toward the forwardmost toe location 22 or away from the forwardmost toe location 22 in response to a change in force of the foot acting on the sole structure 12 (e.g., wearer going from a sitting position to a standing position). In yet another example, the controller 20 may move the upper heel 40 based on the controller 20 sensing a physical change to the foot (e.g., swelling of the foot such as after a long walk or run). The controller 20 may also lock the upper heel 40 in the desired position, thereby inhibiting movement of the upper heel 40 after the desired position is set.

An optional computing device 80 may be in communication with the controller 20 may include a processor 80*a* that is configured to execute instructions stored in a memory unit 80*b*, which may be a nontransitory computer-readable medium, such as a random-access memory (RAM) and/or read-only memory (ROM). The computing device 80 could be a computer, a mobile phone (e.g., smartphone), or a tablet, for example, or any other communication device or network of devices. The computing device 80 may be in communication with the controller 20 via, for example, an internet, Wi-Fi, Bluetooth®, or cellular connection or any other wireless communication protocol.

The memory unit 80*b* may store user profiles to be selected. In some forms, the user profiles include a predetermined closed position of the article of footwear 10 and/or historical movements of the heel assembly 16 (lower heel 38 and upper heel 40) based on activities (e.g., walking, running, sitting) and/or sensor data.

In one form, the wearer performs a gesture or motion to move the lower heel 38 between the closed state and the open state and/or to move the upper heel 40 among the plurality of positions. In one example, the gesture or motion includes tapping the forwardmost toe location 22 of the article of footwear 10 one or more times against a floor, knocking the heel assembly 16 against the floor in a specified manner, or planting the heel assembly 16 and swiveling the forwardmost toe location 22. In another example, the gesture or motion may include interaction between both the left and right articles of footwear 10. That is, the gesture or motion may include positioning one article of footwear 10 near or at a specific location of the other article of footwear 10, or tapping both the left and right articles of footwear 10 together. In yet another form, a voice command may be given to the computing device 80, for example, to move the lower heel 38 between the closed state and the open state and/or to move the upper heel 40 among the plurality of positions.

The article of footwear 10 of the present disclosure also provides the benefit of adapting to each foot of the wearer. For example, in some instances, the left foot of the wearer may have a different length than the right foot of the wearer, thus, desiring different size footwear for each foot. The article of footwear 10 of the present disclosure is able to adapt to each foot as disclosed above while providing improved comfort during various activities.

With reference to FIGS. 11-26, another article of footwear 410 is provided. The structure and function of the article of footwear 410 may be similar or identical to the article of footwear 10 described above, apart from any exception noted below.

Figure 11:
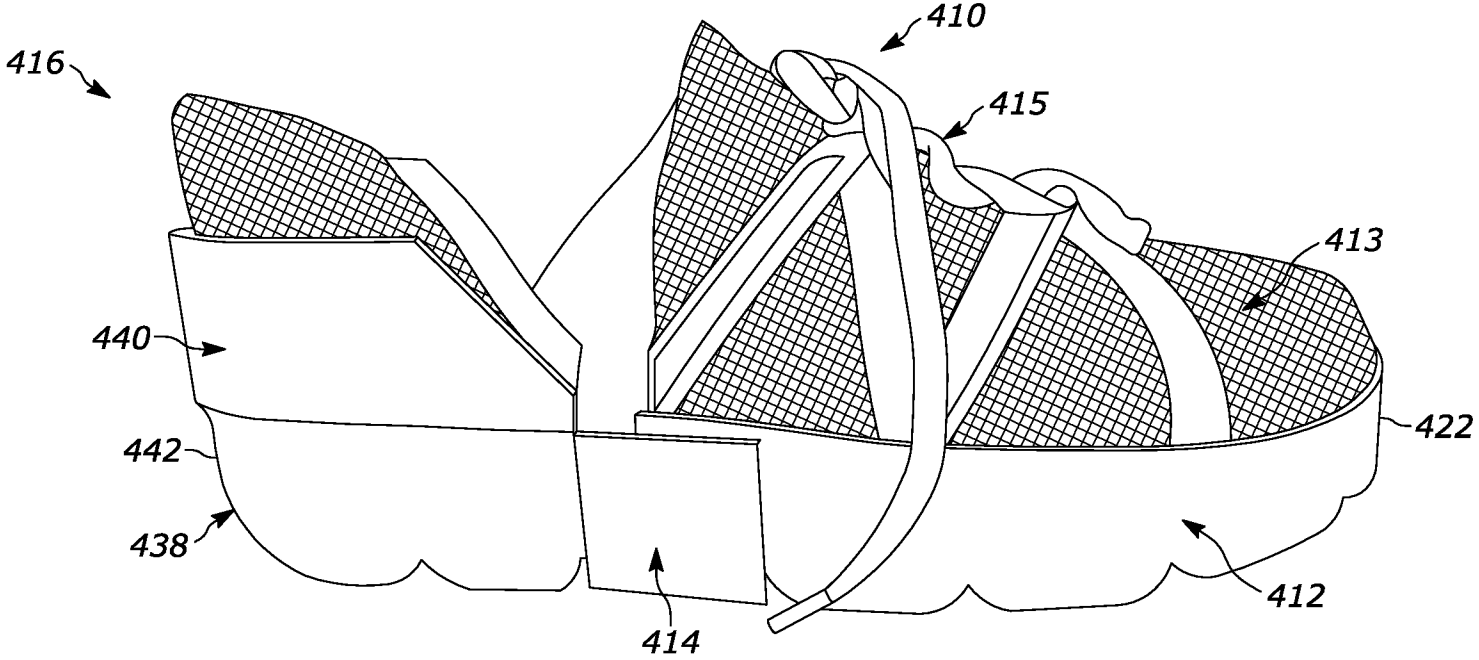
FIG. 11 is a side view of another article of footwear according to the principles of the present disclosure.
Figure 12:
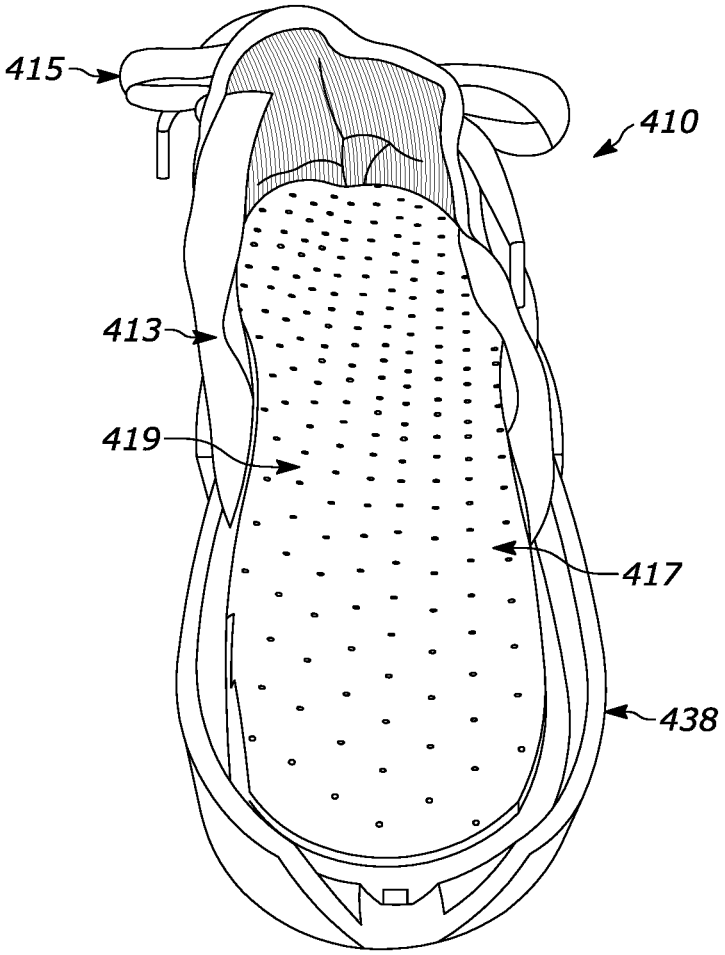
FIG. 12 is a rearview of the article of footwear of FIG. 11 including an insole and with a portion of a heel assembly removed for clarity.
Figure 13:
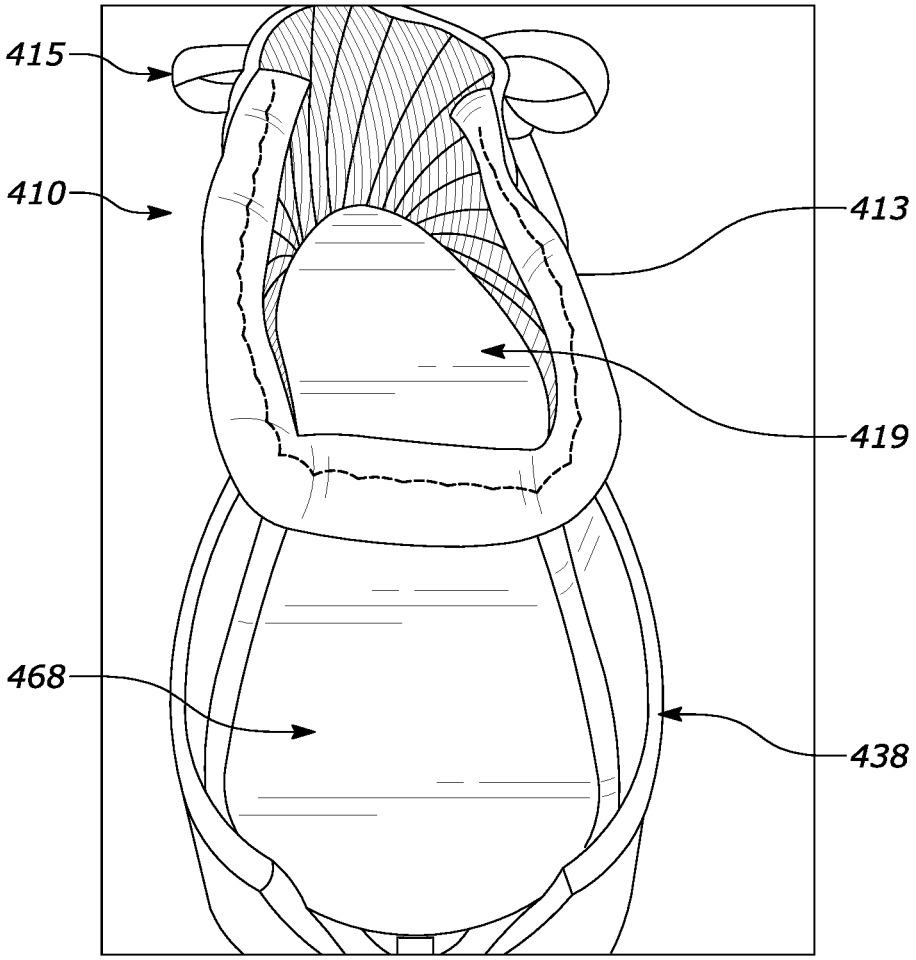
FIG. 13 is a rearview of the article of footwear of FIG. 11 with the insole and a portion of the heel assembly removed for clarity.
Figure 14:
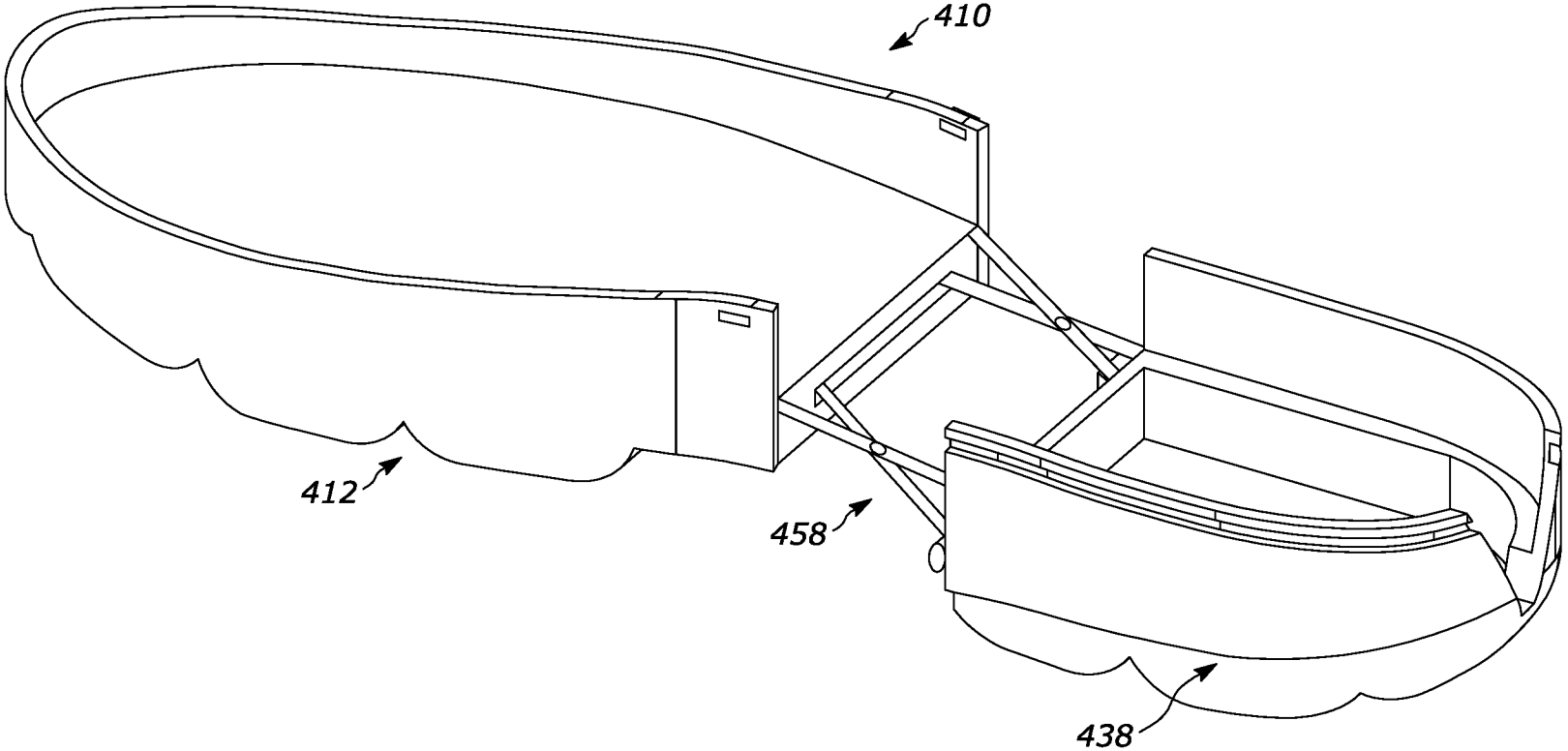
FIG. 14 is a perspective view of a sole structure and a portion of a heel assembly of the article of footwear of FIG. 11 with a lower heel of the heel assembly in an extended state.

With reference to FIGS. 11-13, in one form, the article of footwear 410 includes a sole structure 412 (FIG. 11), an upper portion 413, an optional cover member 414 (FIG. 22) and a heel assembly 416. The sole structure 412 extends in a longitudinal direction of the article of footwear 410 and defines a forwardmost toe location 422 (FIG. 11). The sole structure 412 can be formed by a midsole and/or an outsole. In the example illustrated, the article of footwear 410 includes a removable orthotics/podiatrist insole 417 (FIG. 12) disposed on the sole structure 412 and providing additional cushioning, for example, to the article of footwear 410. In some forms, the article of 410 may not include the insole 417 without departing from the scope of the present disclosure.

In the example illustrated, the upper portion 413 is removably secured to the sole structure 412 to define a foot-receiving chamber 419 configured to receive an object (i.e., a foot of a user). That is, the upper portion 413 is removably secured to the sole structure 412 by VELCRO®, hook-and-loop fasteners, zippers, or any other suitable attachment means. In this way, cleaning of the upper portion 413 is facilitated. In some forms, the upper portion 413 can be permanently secured to the sole structure 412 using glue, adhesives, or any other suitable attachments means. Still in other forms, the upper portion 413 can be semi-permanently attached to the sole structure 412 using laces, stitching, or any other suitable attachment means. The upper portion 413 is made of a stretchable material or fabric that is allowed to stretch between 1%-100% of its original state. In this way, the upper portion 413 is allowed to adjust for different sized feet (e.g., feet having different dimensions (e.g., lengths and/or widths) or whose dimensions change during use) received in the foot-receiving chamber 419. In some forms, the upper portion 413 may be made of one or more parts sewn or otherwise secured to each other. In some forms, the upper portion 413 includes an attachment structure 415 to facilitate securement of the article of footwear 410 to a foot of a wearer. In the example illustrated, the attachment structure 415 includes a conventional lace system. In some forms, the attachment structure 415 may include one or more straps or belts such as releasably fixed in place by buckles, buttons, hook-and-loop fasteners, for example.

With reference to FIGS. 14-19, the heel assembly 416 includes a lower heel 438 and an upper heel 440. The heel assembly 416 also defines a rearmost heel location 442 (FIG. 11). The lower heel 438 is configured to support a heel of a foot received in the foot-receiving chamber 419 and is movable relative to the sole structure 412 (and the upper portion 413). That is, the lower heel 438 is movable in the longitudinal direction of the article of footwear 410 between a closed or retracted state (FIGS. 16 and 17) in which the forwardmost toe location 422 and the rearmost heel location 442 are spaced apart from each other a first distance, and an open or extended state (FIGS. 14 and 15) in which the forwardmost toe location 422 and the rearmost heel location 442 are spaced apart from each other a second distance that is greater than the first distance.

In some forms, the heel assembly 416 (i.e., lower heel 438 and upper heel 440) is stationary and the sole structure 412 is movable in the longitudinal direction relative to the heel assembly 416. Alternatively or additionally, the sole structure 412 may be split or separated into a left part and a right part that are movable in a transverse direction (i.e., perpendicular to the longitudinal direction of the article of footwear 410) relative to each other, thereby allowing a width of the article of footwear 410 to be further adjusted.

Figure 18:
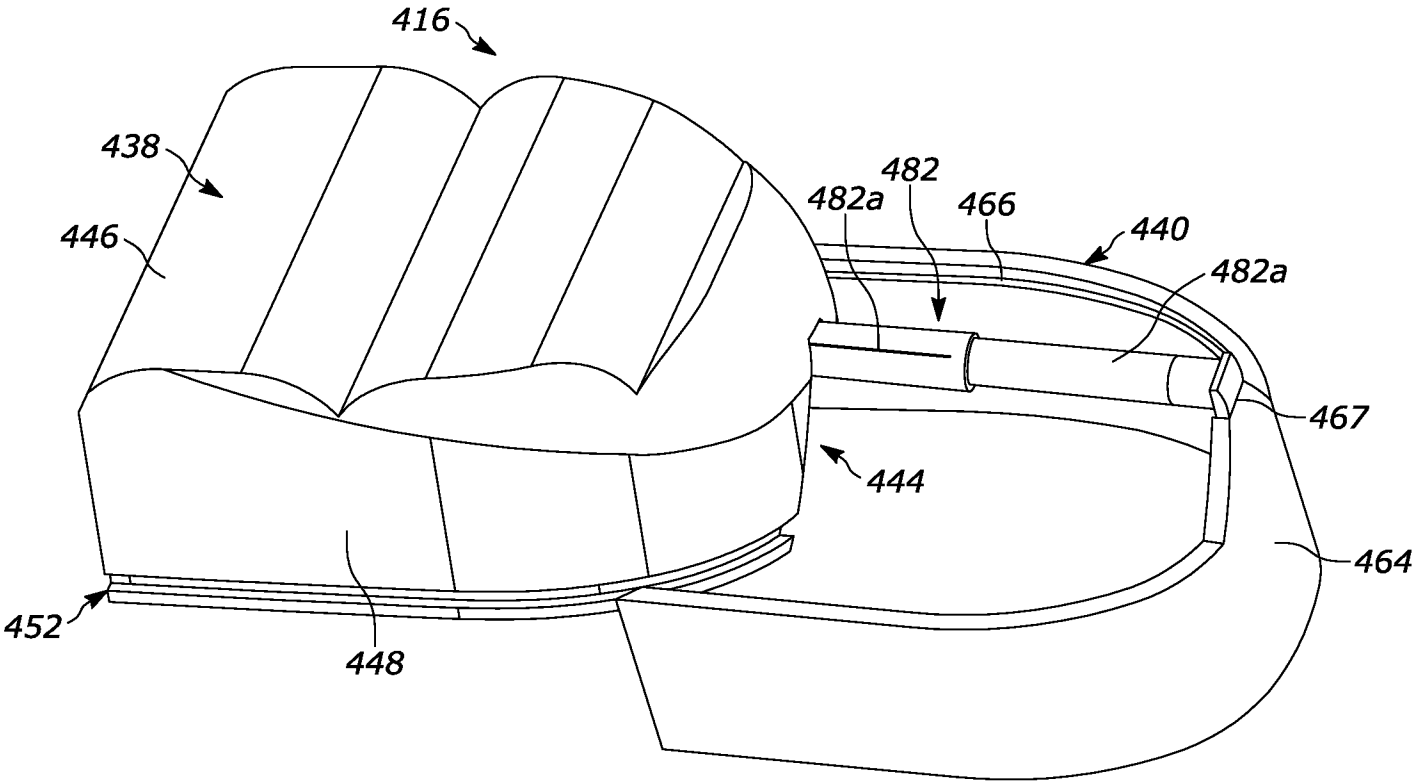
FIG. 18 is a bottom perspective view of the heel assembly of the article of footwear of FIG. 11 with the upper heel in the open position.
Figure 19:
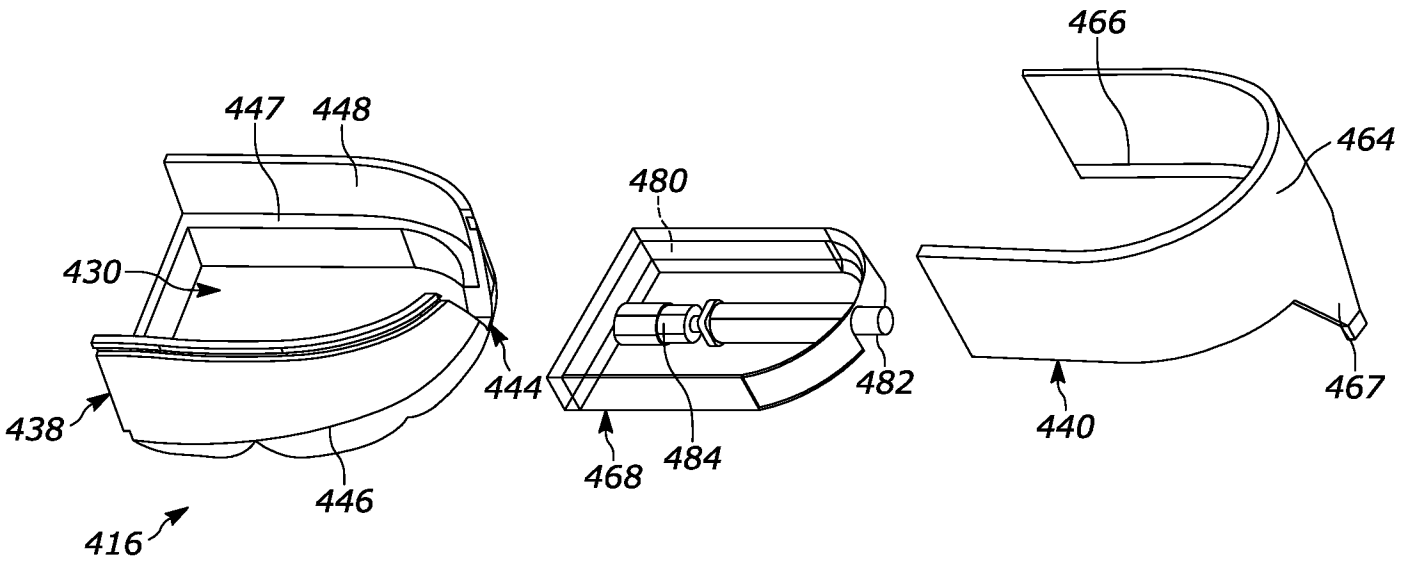
FIG. 19 is an exploded view of the heel assembly of the article of footwear of FIG. 11.
Figure 25:
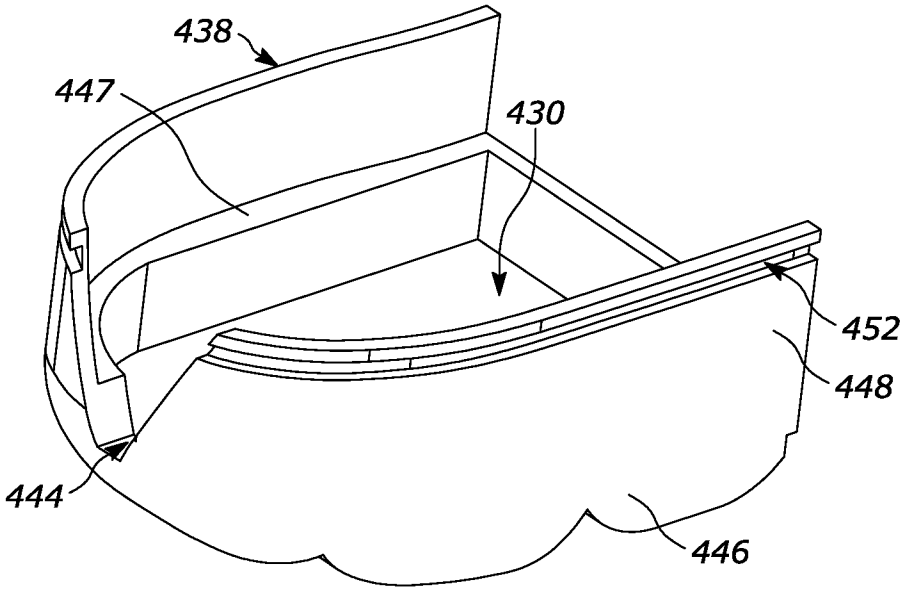
FIG. 25 is a perspective view of the lower heel of the heel assembly of the article of footwear of FIG. 11.

With reference to FIGS. 18, 19 and 25, the lower heel 438 includes a body 446 and an arcuate rim or lip 448 extending upward and around an arcuate periphery of the body 446. In the example illustrated, the body 446 is spaced apart from the sole structure 412 when the lower heel 438 is in the closed state and the open state. The body 446 defines an upper surface 447 (FIGS. 19 and 25) including a pocket or compartment 430 (FIGS. 19 and 25) formed therein. In the example illustrated, the pocket 430 has a generally rectangular shape. In some forms, the pocket 430 may have a circular shape, square shape, or any other shape configured to receive an actuation assembly.

The rim 448 includes a track 452 formed in and around a periphery thereof and that is configured to receive a portion of the upper heel 440. That is, in the example illustrated, the track 452 is formed in an upper, outer surface of the rim 448 and extends from a lateral side of the lower heel 438 around to a medial side of the lower heel 438. In some forms, the track 452 may be formed in an inner surface of the rim 448 or may be formed in an outer surface of the body 446 of the lower heel 438. An opening 444 is defined in a rear portion of the lower heel 438 (i.e., the body 446 and/or the rim 448) and opens through to the pocket 430. In the example illustrated, the opening 444 includes a generally V-shape where an upper portion of the opening 444 has a width that is greater than a width of a lower portion of the opening 444. Stated differently, the opening 444 is tapered from the upper portion of the opening 444 toward the lower portion of the opening 444. In some forms, the opening 444 may have a different shape such as rectangular shape, a square shape, a triangular shape, or any other suitable shape configured to receive a portion of the upper heel 440.

With reference to FIGS. 18 and 19, the upper heel 440 is configured to support the heel of a foot received in the foot-receiving chamber 419 and is movable in the longitudinal direction relative to the lower heel 438 (and the sole structure 412) between a closed position and an open position. The upper heel 440 is slidably engaged with the lower heel 438 and extends vertically upward beyond the lower heel 438. In the example illustrated, the upper heel 440 includes an arcuate body 464, a protrusion 466, and a lip or projection 467. The arcuate body 464 surrounds or wraps around the lower heel 438.

In the example illustrated, the protrusion 466 extends inwardly and around a lower part of an inner surface of the body 464 into the track 452 of the lower heel 438. In this way, the upper heel 440 is slidably engaged with the lower heel 438. It should be understood that, in some forms, the protrusion 466 may be associated with the lower heel 438 and the track 452 may be formed in the upper heel 440. When the protrusion 466 is received in the track 452 of the lower heel 438, the upper heel 440 is substantially inhibited from moving in a vertical direction and a lateral direction relative to the lower heel 438. The projection 467 extends downward from a periphery of the body 464 and is configured to be received in the opening 444 of the lower heel 438. That is, when the upper heel 440 is in the closed position, for example, the projection 467 is received in the opening 444 of the lower heel 438, thereby forming a continuous, uniform outer profile of the heel assembly 416. In this way, the shape of the projection 467 corresponds to the shape of the opening 444 of the lower heel 438. It should be understood that, in some configurations, the lower heel 438 may also be adjusted in a vertical direction (adjusting a height of the lower heel 438) thereby permitting further customization for wearers with legs of different lengths.

Figure 21:
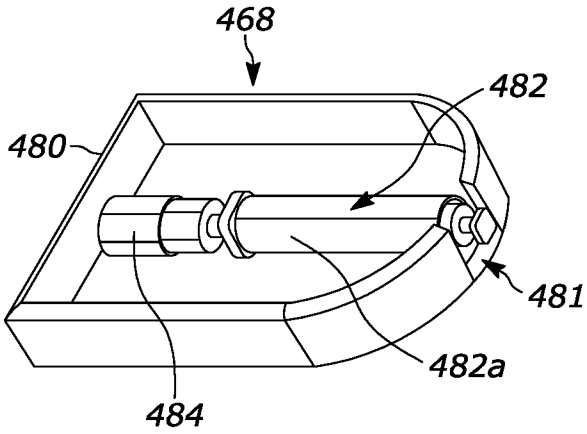
FIG. 21 is a perspective view of the actuator assembly of FIG. 20 of the article of footwear of FIG. 11 in rest or non-actuated state.
Figure 20:
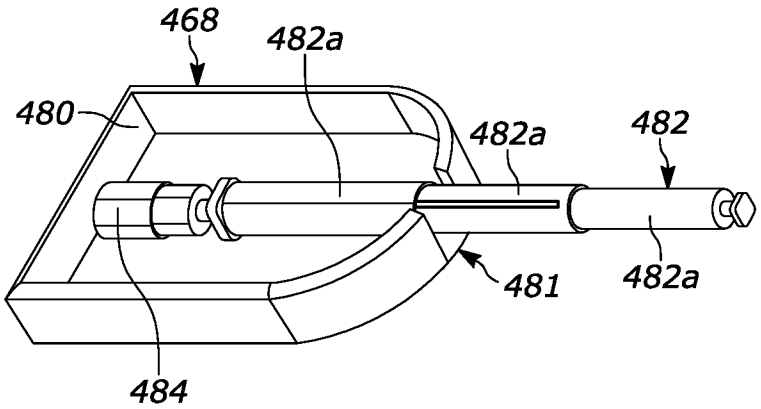
FIG. 20 is a perspective view of an actuator assembly of the article of footwear of FIG. 11 in an actuated state.

With reference to FIGS. 19-21, a removable power pack or actuator assembly 468 is associated with the heel assembly 416 and is configured to move the upper heel 440 in the longitudinal direction of the article of footwear 410 relative to the lower heel 438 between the closed position (FIG. 11) and the open position (FIG. 18). In one example, the actuator assembly 468 may include a fluid-tight housing 480, a telescoping structure 482 and an actuator 484. The housing 480 has a shape that corresponds to the shape of the pocket 430 of the lower heel 438 and is disposed within the pocket 430 so that an upper surface of the housing 480 is flush with the upper surface 447 of the lower heel 438. In this way, the power pack 468 is at least partially disposed within the lower heel 438 (i.e., the power pack 468 is disposed at least partially inside of the lower heel 438).

The telescoping structure 482 and the actuator 484 are located within the housing 480 and are coupled to the housing 480 so as to inhibit unwanted movement within the housing 480. In some forms, packing material (not shown), for example, may be disposed within the housing 480 and surrounding the telescoping structure 482 and the actuator 484 so as to further inhibit unwanted movement within the housing 480. The telescoping structure 482 has an end that is secured to the projection 467 of the upper heel 440 using any suitable attachment means such as mechanical fasteners, welding, or an interference fit, for example. In this way, the telescoping structure 482 is movable between a closed state (FIG. 21) in which the telescoping structure 482 moves the upper heel 440 to the closed position and an open state (FIG. 20) in which the telescoping structure 482 moves the upper heel 440 to the open position. In the example illustrated, the telescoping structure 482 includes a plurality of telescoping cylinders 482*a* that are configured to slide within each other as the telescoping structure 482 moves between the open and closed states. One or more of the telescoping cylinders 482*a* are configured to extend through an opening 481 in the housing 480 and through the opening 444 of the lower heel 438 when the telescoping structure 482 is in the open state. In the example illustrated, the innermost cylinder 482*a* is secured to the projection 467 of the upper heel 440 such that movement of the telescoping structure 482 causes corresponding movement of the upper heel 440. It should be understood that although the telescoping structure 482 is used as the means to move the upper heel 440, in some forms, other assemblies may be used to move the upper heel 440 such as a jackscrew assembly that includes a worm screw, a worm gear, and a lead screw.

The actuator 484 is configured to move the telescoping structure 482 between the closed state and the open state. That is, operation of the actuator 484 in a first operation mode causes the telescoping structure 482 to move to the open state and operation of the actuator 484 in a second operation mode causes the telescoping structure 482 to move to the closed state. In one example, the actuator 484 may be a motor such as an electric motor. In another example, the power pack 468 may include electrical components (e.g., batteries, coils, motors) that operate to move the upper heel 440 between the closed position and the open position.

Figure 15:
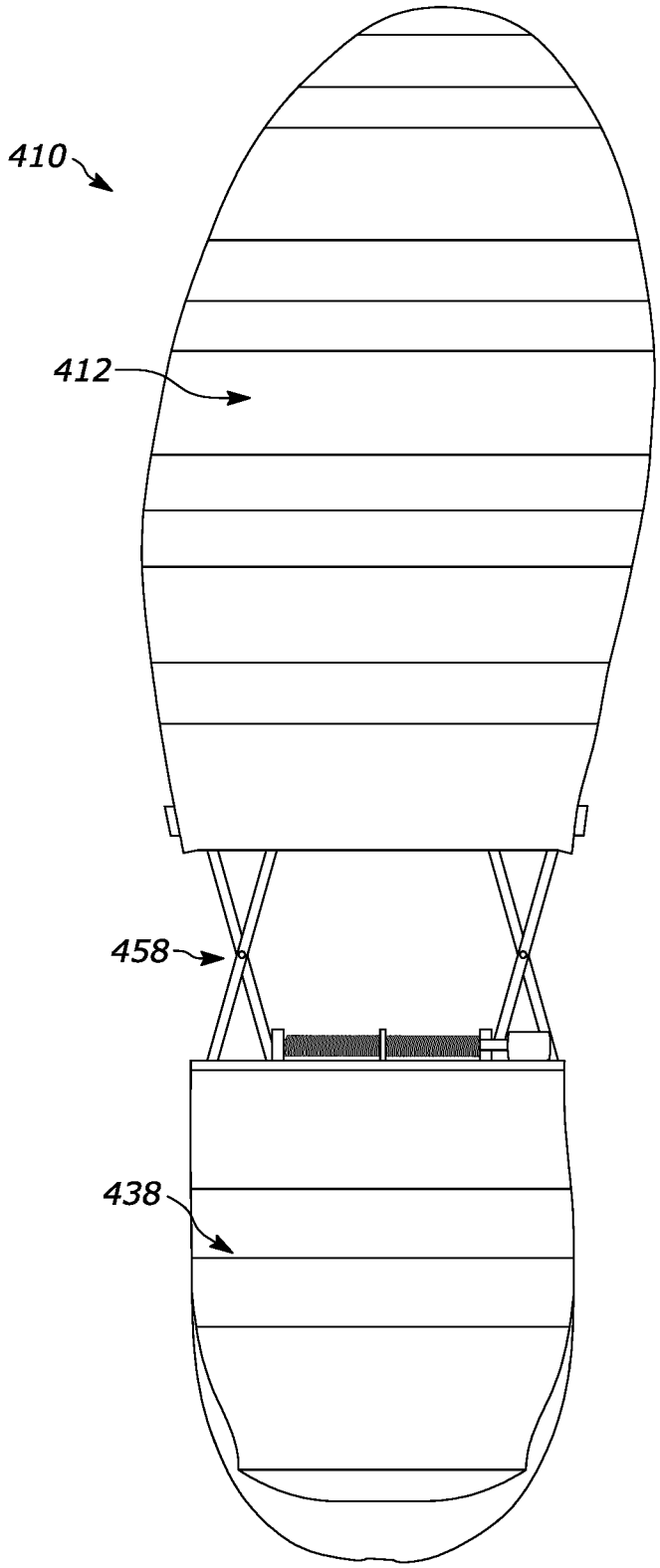
FIG. 15 is a bottom view of the sole structure and the portion of the heel assembly of the article of footwear of FIG. 11 with the lower heel of the heel assembly in the extended state.
Figure 16:
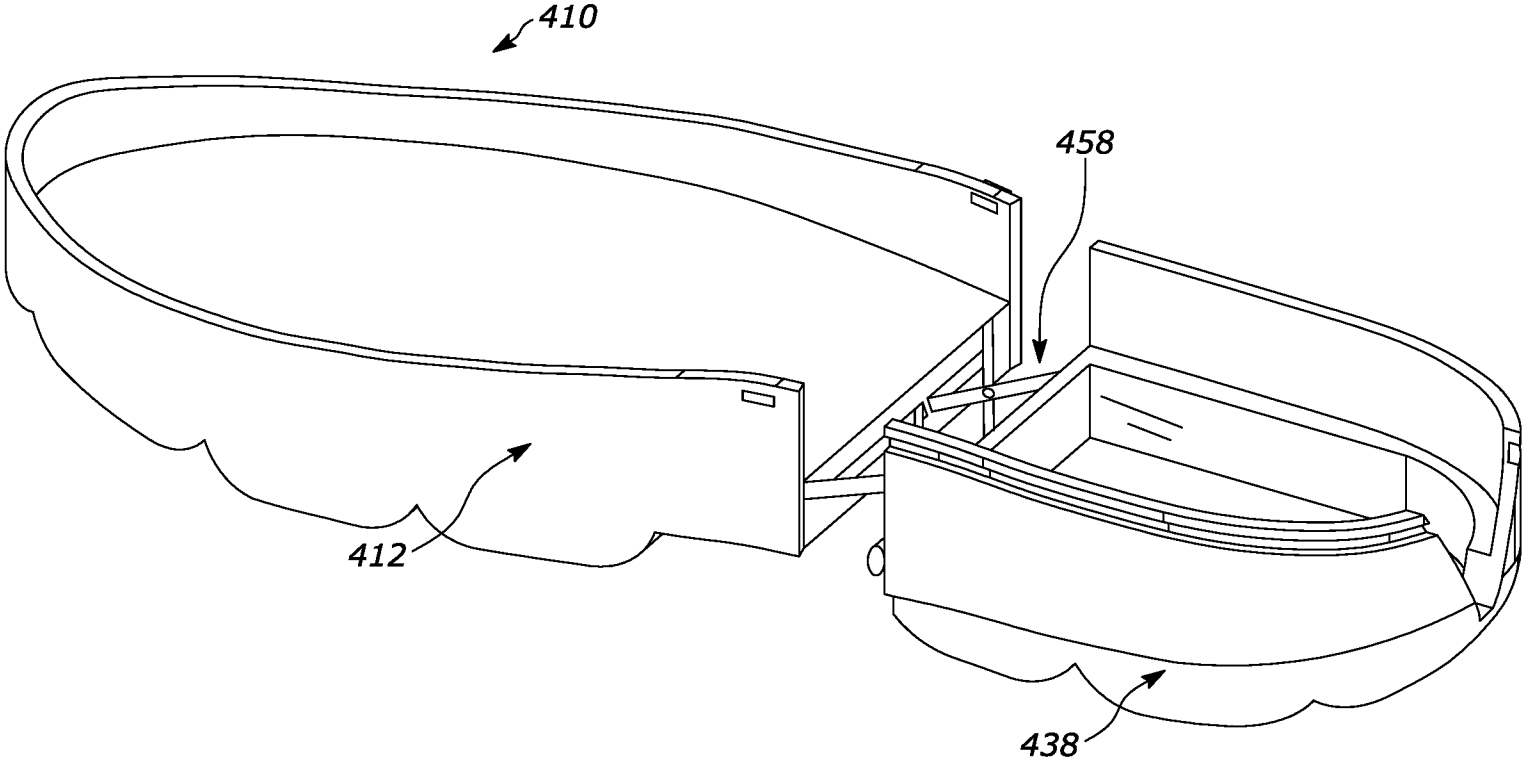
FIG. 16 is a perspective view of the sole structure and the portion of the heel assembly of the article of footwear of FIG. 11 with the lower heel in a retracted state.
Figure 17:
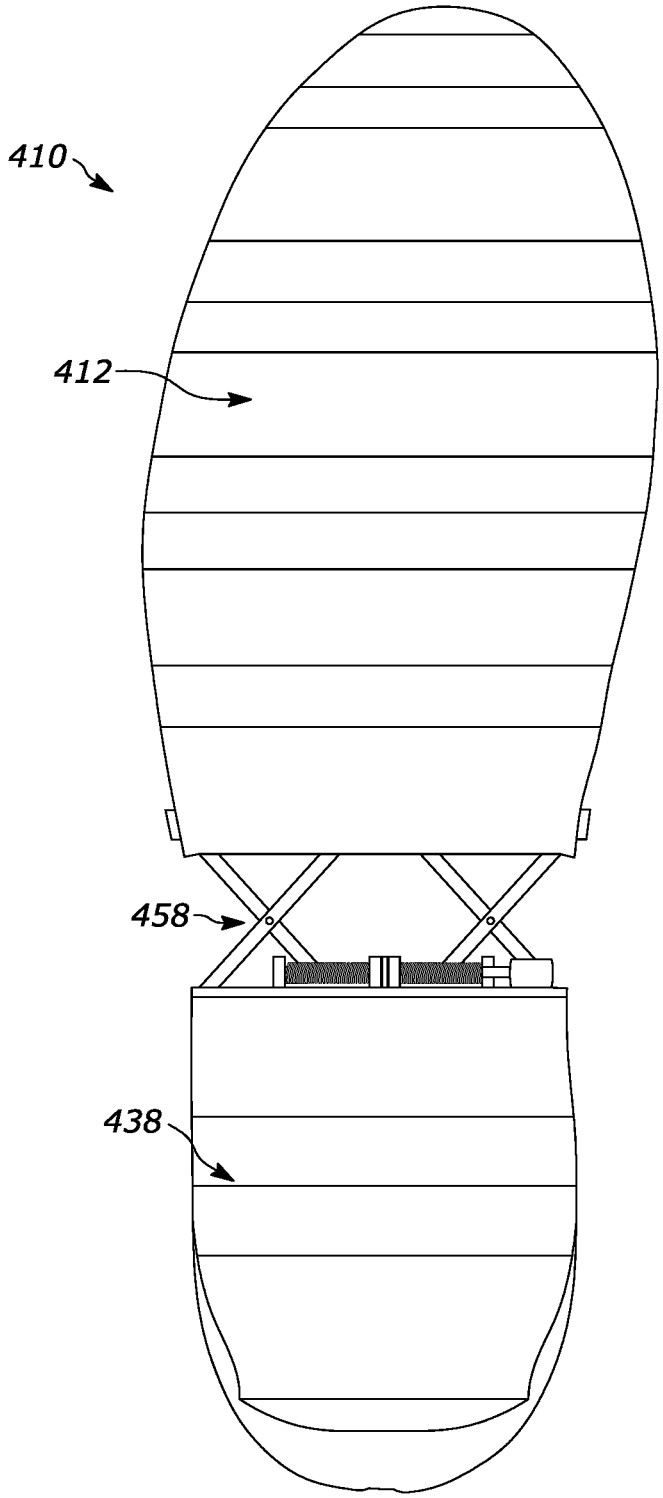
FIG. 17 is a bottom view of the sole structure and the portion of the heel assembly of the article of footwear of FIG. 11 with the lower heel in the retracted state.
Figure 22:
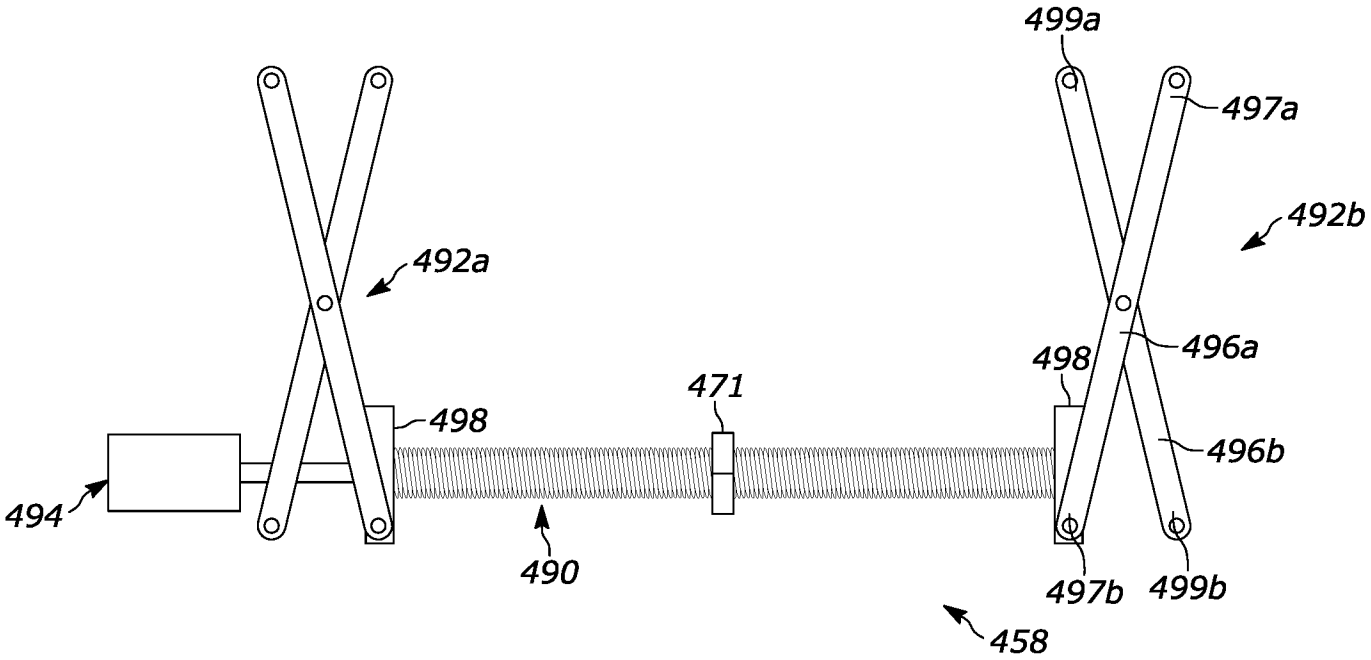
FIG. 22 is a top view of another actuator assembly of the article of footwear of FIG. 11 in an actuated state.
Figure 23:
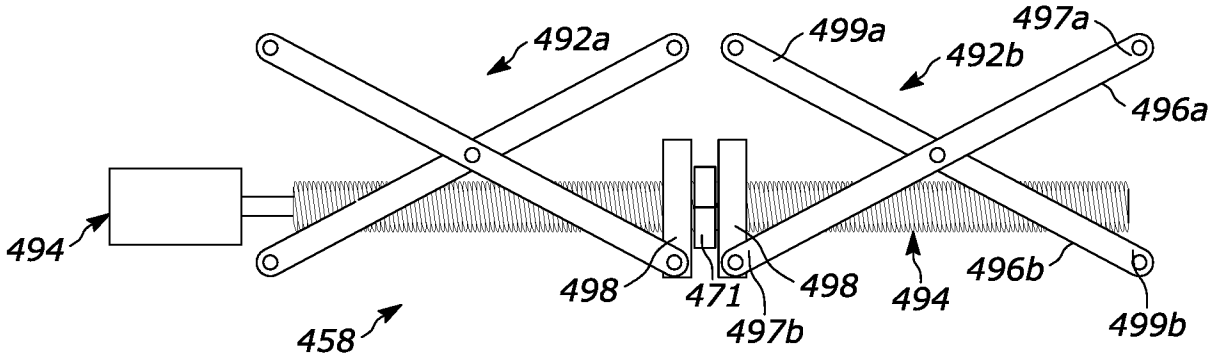
FIG. 23 is a top view of the actuator assembly of FIG. 22 of the article of footwear of FIG. 11 in a rest or non-actuated state.
Figure 24:
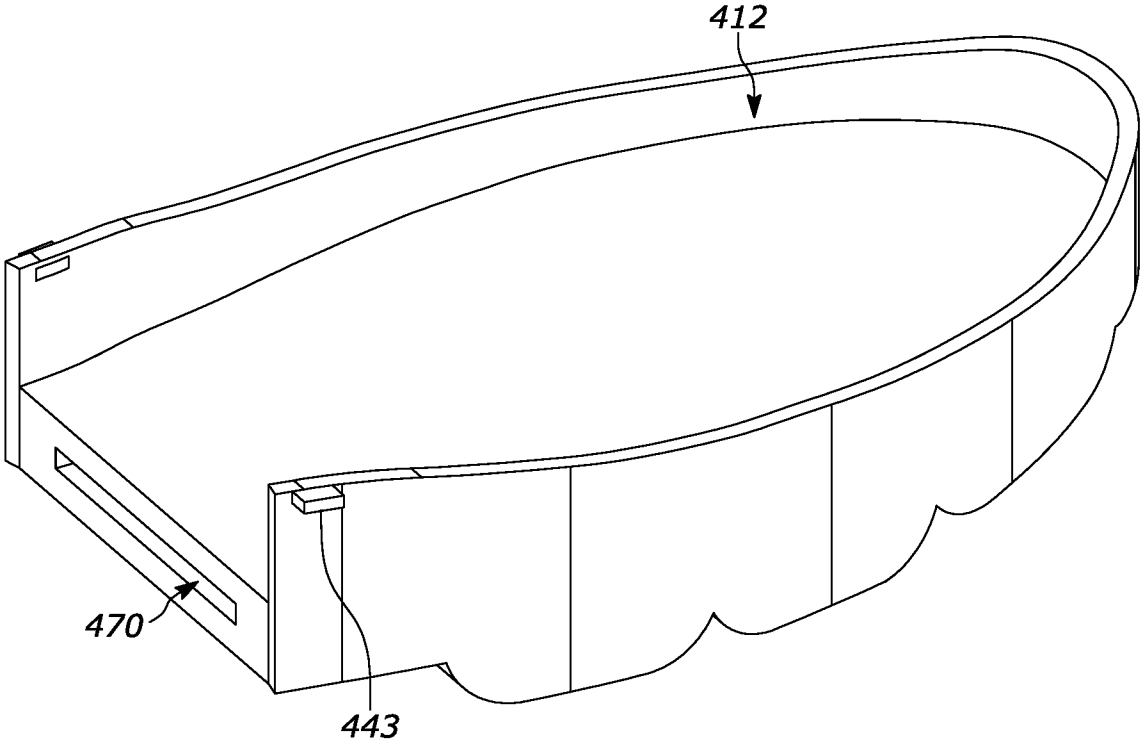
FIG. 24 is a perspective view of a sole structure of the article of footwear of FIG. 11.

With reference to FIGS. 15, 22, and 23, an actuator assembly 458 is coupled to the lower heel 438 and the sole structure 412, and is configured to move the lower heel 438 in the longitudinal direction of the article of footwear 410 between the extended state (FIGS. 14 and 15) and the retracted state (FIGS. 16 and 17). In one example, the actuator assembly 458 is located outside of the lower heel 438 between the lower heel 438 and the sole structure 412. The actuator assembly 458 includes a threaded lead screw 490, a pair of movable structures 492*a*, 492*b* and an actuator 494. In the example illustrated, the lead screw 490 is mounted to a front portion of the lower heel 438 along a surface facing toward the foremost toe location 422. In some forms, the lead screw 490 may be mounted to other locations of the lower heel 438 such as the lateral side of the lower heel 438 or the medial side of the lower heel 438.

The movable structure 492*a* is located proximate one of the lateral side and medial side of the lower heel 438 and the movable structure 492*b* is located proximate the other of the medial side and lateral side of the lower heel 438. In the example illustrated, each movable structure 492*a*, 492*b* includes a pair of blades 496*a*, 496*b* that are coupled to each other using a fastener, for example, at or near a center portion thereof. In this way, the pair of blades 496*a*, 496*b* are movable relative to each other in a scissor arrangement. A first end 497*a* of the blade 496*a* of each movable structure 492*a*, 492*b* is secured to the sole structure 412 using fasteners. In the example illustrated, the first end 497*a* is secured to the sole structure 412 at or near a periphery of the sole structure 412. In some forms, the first end 497*a* is secured to the sole structure 412 using adhesives, welding, or any other suitable attachment means. A second end 497*b* of the blade 496*a* of each movable structure 492*a*, 492*b* is secured to a block 498 threadably engaged with the lead screw 490. A first end 499*a* of the blade 496*b* of each movable structure 492*a*, 492*b* is coupled to the sole structure 412 and disposed within a slot 470 (FIG. 24) formed in a surface of the sole structure 412 that faces the lower heel 438. In this way, the first end 499*a* may traverse the slot 470 as the lower heel 438 moves between the retracted state and the extended state. A second end 499*b* of the blade 496*b* of each movable structure 492*a*, 492*b* is coupled to the lower heel 438.

The actuator 494 is coupled to the lead screw 490 and is configured to rotate the lead screw 490. Rotation of the lead screw 490 causes the blocks 498 to traverse a length of the lead screw 490, which, in turn, causes the movable structures 492*a*, 492*b* to move between extended positions (FIGS. 14, 15 and 22) and retracted positions (FIGS. 16, 17, and 23). When the movable structures 492*a*, 492*b* are in the extended positions, the lower heel 438 is in the extended state, and when the movable structures 492*a*, 492*b* are in the retracted positions, the lower heel 438 is in the retracted state. The lead screw 490 is threaded in a way such that there is little to no backlash between the blocks 498 and the lead screw 490. In this way, the lower heel 438 is inhibited from moving when set in a predetermined or preset position. In the example illustrated, the lead screw 490 includes a separating block 471 disposed near a center portion thereof to inhibit block 498 of one movable structure 492*a* from engaging or contacting block 498 of the other movable structure 492*b*. It should be understood that although the article of footwear 410 is shown having two movable structures 492*a*, 492*b*, the article of footwear 410 can include one movable structure or more than two movable structures without departing from the scope of the present disclosure.

In some forms, the actuator 494 may include a motor, for example, that operates in a first operation mode causing the lower heel 438 to move relative to the sole structure 412 in a first longitudinal direction (e.g., toward the extended state) and a second operation mode causing the lower heel 438 to move relative to the sole structure 412 in a second longitudinal direction (toward the retracted state). The motor may be an electric motor or any other suitable motor that rotates the lead screw 490. The actuator 494 may be housed in a fluid tight housing to inhibit fluid and debris from entering.

Figure 26:
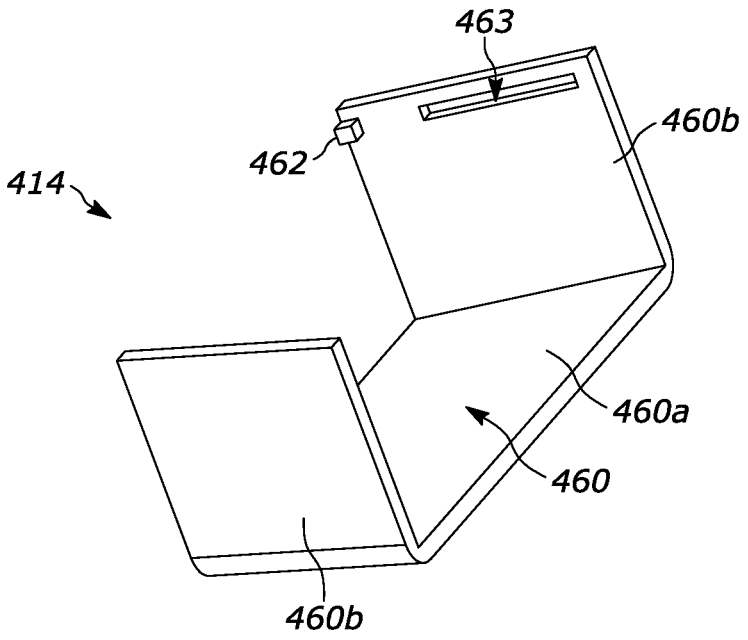
FIG. 26 is a perspective view of a cover member of the article of footwear of FIG. 11.

With reference to FIG. 26, the optional cover member 414 may at least partially wrap around the sole structure 412 and the lower heel 438 to cover a gap therebetween when the lower heel 438 is in the retracted state and the extended state. In the example illustrated, the cover member 414 is coupled to the sole structure 412 and the lower heel 438. In the example illustrated, the cover member 414 includes a body 460 and a plurality of protrusions 462 (only one shown in the figure). The body 460 has a generally U-shape and includes a connecting wall 460*a* and outer walls 460*b*. The outer walls 460*b* extend upward from respective opposing ends of the connecting wall 460*a*. Each outer wall 460*b* defines an elongated slot 463 (only one shown in the figure) formed therein and extending in the longitudinal direction of the article of footwear 410. In the example illustrated, the elongated slot 463 is formed in an upper, inner surface of the outer wall 460*b* and is configured to receive a projection 443 (FIG. 24) of the sole structure 412. In some forms, the elongated slot 463 may extend in a slanted direction and may be located in a different area of the outer wall 460*b* (e.g., lower inner surface of the outer wall 460*b*).

In the example illustrated, each protrusion 462 has a generally rectangular shape and extends inwardly from the inner surface of a respective outer wall 460*b* (extend toward a center of the article of footwear 410). Each protrusion 462 extends into a respective track 452 in the lower heel 438. In this way, when the lower heel 438 moves from the retracted state to the extended state, the cover member 414 moves along with the lower heel 438, thereby continuing to cover the gap between the lower heel 438 and the sole structure 412. Stated differently, when the lower heel 438 moves from the retracted state to the extended state, the projections 443 of the sole structure 412 traverses the elongated slots 463 such that the cover member 414 is permitted to move in the longitudinal direction of the article of footwear 410 relative to the sole structure 412.

Electrical components of the article of footwear 410 can be charged using wireless charging methods (e.g., induction charging and/or solar charging), wired charging methods (e,g., plugging in the article of footwear 410 to a power source), or other charging methods such as using kinetic energy (e.g., kinetic energy generated from walking) to charge the article of footwear 410. It should be understood that the moving parts of the article of footwear 410 can be achieved using mechanical means, electrical means, or a combination of both mechanical and electrical means. The article of footwear 410 may also include lights, massagers, cooling/heating sources, charge indicators, speakers for music, a shoe finder alarm, an anti-theft device, aux ports for additional peripheral devices, ability to charge other devices, pull out tray to disguise and hold money, air tag, fitness tracker etc.

Figure 27:
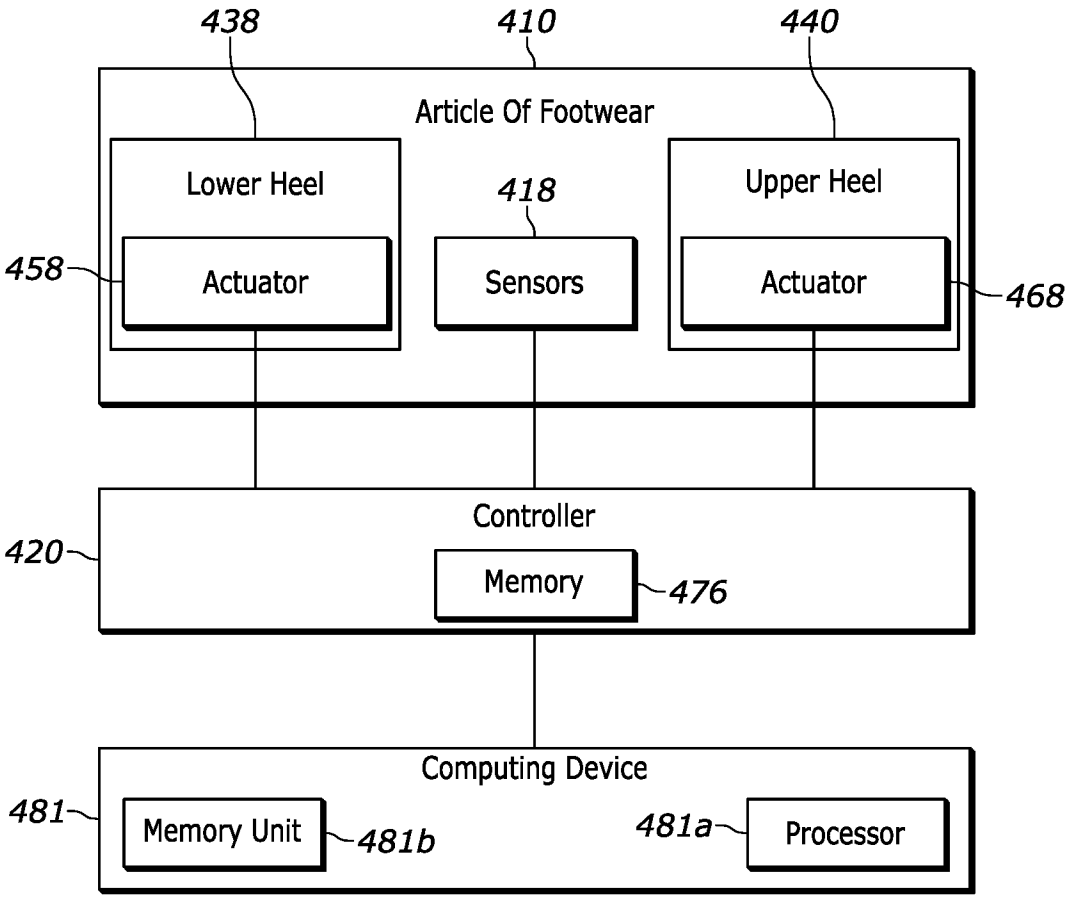
FIG. 27 is a block diagram illustrating communication between components of the article of footwear of FIG. 11 and a controller.

With reference to FIG. 27, sensors 418 are associated with the article of footwear 410 and are configured to detect a foot in the foot-receiving chamber 419. That is, the sensors 418 may be secured to one or more of the sole structure 412, the upper portion 413, and the heel assembly 416 of the article of footwear 410 and configured to detect a foot in the foot-receiving chamber 419.

A controller 420 is in communication with the sensors 418, the lower heel 438 (e.g., the actuator assembly 458), and the upper heel 440 (e.g., the actuator assembly 468), and may monitor and control operations of the lower heel 438 and the upper heel 440 based on data received from the sensors 418. In one example, the controller 420 is in communication with the sensors 418, the lower heel 438, and the upper heel 440 using a wireless communication protocol (e.g., a Bluetooth®-type protocol, a cellular protocol, a wireless fidelity (Wi-Fi)-type protocol, a near-field communication (NFC) protocol, an ultra-wideband (UWB)

protocol, among others). The controller 420 may be located within one of the sole structure 412 or the heel assembly 416. In some forms, the controller 420 may be located within a fluid-tight pocket within one of the sole structure 412 or the heel assembly 416.

Figure 28:
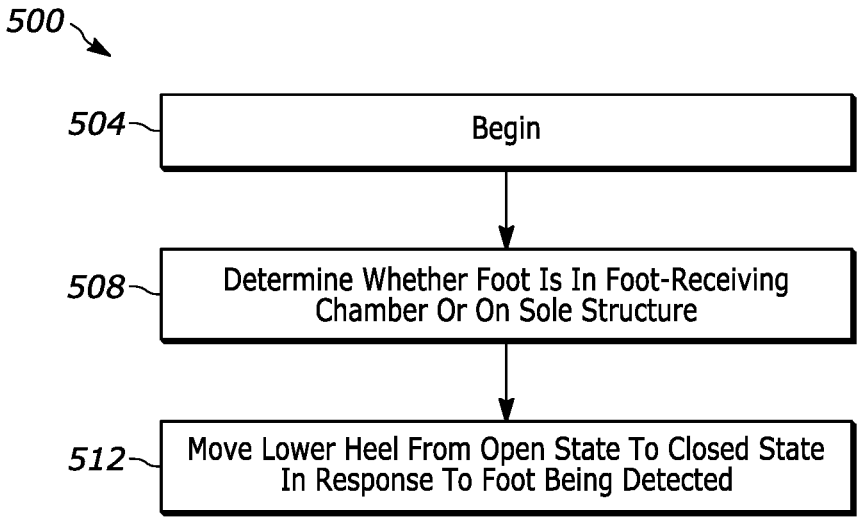
FIG. 28 is a flowchart depicting an algorithm for operating the article of footwear of FIG. 11 in accordance with the teachings of the present disclosure.

Referring to FIG. 28, an example control algorithm 500 for controlling operations of the upper heel 440 and/or the lower heel 438 while the foot is received in the foot-receiving chamber 419 is illustrated. The control algorithm begins at 504 where the wearer sets the lower heel 438 in a preset position relative to the sole structure 412. The present position may correspond to the shoe size of the wearer. In some forms, the wearer may adjust the preset position of the lower heel 438 relative to the sole structure 412 in response to a change with the anatomy or physiology of the wearer's foot. For example, if the wearer's foot swells, then the preset position of the lower heel 438 may be adjusted around 1.8 centimeters (cm), for example, such that it is positioned a greater distance apart from the sole structure 412. The preset position of the wearer may be stored within a memory unit 476, which may be a nontransitory computer-readable medium, such as a random-access memory (RAM) and/or read-only memory (ROM). The memory unit 476 may store foot sizes and other data about wearers of the article of footwear 410.

At 508, the control algorithm, using the controller 420, determines whether a foot is in the foot-receiving chamber 419 and/or on the sole structure 412 based on data received from the sensors 418. At 512, the control algorithm, using the controller 420, moves the upper heel 440 from the open position to the closed position based on the foot being within the foot-receiving chamber 419. In this way, a desired comfort level of the foot within the foot-receiving chamber 419 is maintained during various activities while wearing the article of footwear 410.

An optional computing device 481 (FIG. 27) may be in communication with the controller 420 may include a processor 481*a* that is configured to execute instructions stored in a memory unit 481*b*, which may be a nontransitory computer-readable medium, such as a random-access memory (RAM) and/or read-only memory (ROM). The computing device 481 could be a computer, a mobile phone (e.g., smartphone), or a tablet, for example, or any other communication device or network of devices. The computing device 481 may be in communication with the controller 420 via, for example, an internet, Wi-Fi, Bluetooth®, or cellular connection or any other wireless communication protocol. The wearer may control the position of the lower heel 438 and the upper heel 440 based on commands and/or inputs into the computing device 481. In some example, the commands may be verbal commands given to the computing device 481.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

In this application, the term "controller" and/or "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components (e.g., op amp circuit integrator as part of the heat flux data module) that provide the described functionality; or a combination of some or all of the above, such as in a system-on-chip.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An article of footwear comprising:

a sole structure defining a forwardmost toe location of the article of footwear;

a heel assembly defining a rearmost heel location of the article of footwear, the heel assembly comprising a lower heel movable relative to the sole structure and an upper heel movable relative to the sole structure, wherein one of the lower heel and upper heel defines a track and the other of the lower heel and the upper heel includes a protrusion slidably received in the track; and a first actuator assembly coupled to the heel assembly and configured to move the upper heel relative to the lower heel between a closed position and an open position.

2. The article of footwear of claim 1, further comprising an upper portion removably secured to the sole structure to define a foot-receiving chamber.

3. The article of footwear of claim 2, wherein the upper portion is made of a stretchable material.

4. The article of footwear of claim 1, wherein the first actuator assembly includes:

a telescoping structure coupled with the upper heel and moveable between a closed state in which the upper heel is in the closed position and an open state in which the upper heel is in the open position; and an actuator configured to move the telescoping structure between the closed state and the open state.

5. The article of footwear of claim 4, wherein the first actuator assembly is disposed within a recess formed in the lower heel.

6. The article of footwear of claim 4, wherein:

the upper heel includes an arcuate body and a lip extending downward from the arcuate body; and the lower heel includes an arcuate periphery that defines an opening that is configured to receive the lip of the upper heel, wherein the telescoping structure is coupled to the lip of the upper heel.

7. The article of footwear of claim 4, further comprising:

a sensor configured to detect an object on the sole structure; and a controller in communication with the actuator and configured to actuate the actuator to move the telescoping structure from the open state to the closed state in response to the sensor detecting the object on the sole structure.

8. The article of footwear of claim 1, further comprising a second actuator assembly configured to move the lower heel relative to the sole structure between an extended state and a retracted state.

9. The article of footwear of claim 8, wherein when the lower heel is in the retracted state, the forwardmost toe location and the rearmost heel location are spaced apart from each other a first distance, and when the lower heel is in the extended state, the forwardmost toe location and the rearmost heel location are spaced apart from each other a second distance that is greater than the first distance.

10. The article of footwear of claim 8, wherein the second actuator assembly is located outside the lower heel.

11. The article of footwear of claim 10, wherein the first actuator assembly is located at least partially inside the lower heel.

12. The article of footwear of claim 1, wherein the lower heel is spaced apart from the sole structure.

13. An article of footwear comprising:

a sole structure defining a forwardmost toe location of the article of footwear;

a heel assembly defining a rearmost heel location of the article of footwear, the heel assembly comprising:

a lower heel movable relative to the sole structure between a retracted state in which the forwardmost toe location and the rearmost heel location are spaced apart from each other a first distance and an extended state in which the forwardmost toe location and the rearmost heel location are spaced apart from each other a second distance, the second distance being greater than the first distance; and an upper heel movable relative to the lower heel between a closed position and an open position;

a first actuator assembly coupled to the heel assembly and configured to move the upper heel relative to the lower heel between the closed position and the open position;

a sensor configured to detect an object on the sole structure; and a controller in communication with the sensor and the first actuator assembly, the controller configured to:

determine whether the object is on the sole structure; and actuate the first actuator assembly to move the upper heel from the open position to the closed position in response to the sensor detecting the object on the sole structure.

14. The article of footwear of claim 13, further comprising an upper portion removably secured to the sole structure to define a foot-receiving chamber.

15. The article of footwear of claim 13, wherein:

the upper heel includes an arcuate body and a lip extending downward from the arcuate body; and the lower heel includes an arcuate periphery that defines an opening that is configured to receive the lip of the upper heel, wherein the first actuator assembly includes a telescoping structure that is coupled to the lip of the upper heel.

16. The article of footwear of claim 13, further comprising a second actuator assembly configured to move the lower heel relative to the sole structure between the extended state and the retracted state.

17. The article of footwear of claim 16, wherein the second actuator assembly is located outside the lower heel.

18. The article of footwear of claim 17, wherein the first actuator assembly is located at least partially inside the lower heel.

19. The article of footwear of claim 13, further comprising a cover member coupled to the heel assembly and the sole structure, and wherein the cover member covers a gap between the heel assembly and the sole structure.

20. An article of footwear comprising:

a sole structure defining a forwardmost toe location of the article of footwear;

a heel assembly defining a rearmost heel location of the article of footwear, the heel assembly comprising:

a lower heel movable relative to the sole structure between a retracted state in which the forwardmost toe location and the rearmost heel location are spaced apart from each other a first distance and an extended state in which the forwardmost toe location and the rearmost heel location are spaced apart from each other a second distance, the second distance being greater than the first distance; and an upper heel movable relative to the lower heel between a closed position and an open position;

a cover member coupled to the heel assembly and the sole structure, the cover member covers a gap between the heel assembly and the sole structure;

a first actuator assembly coupled to the heel assembly and configured to move the upper heel relative to the lower heel between the closed position and the open position, the first actuator assembly located at least partially inside the lower heel;

a second actuator assembly coupled to the sole structure and the lower heel, the second actuator assembly configured to move the lower heel relative to the sole structure between the extended state and the retracted state, the second actuator assembly located outside of the lower heel;

a sensor configured to detect an object on the sole structure; and a controller in communication with the sensor and the first and second actuator assemblies, the controller configured to:

actuate the second actuator assembly to move the lower heel to a preset position relative to the sole structure;

determine whether the object is on the sole structure; and actuate the first actuator assembly to move the upper heel from the open position to the closed position in response to the sensor detecting the object on the sole structure.

* * * * *